US010706817B2

(12) United States Patent
Tang et al.

(10) Patent No.: US 10,706,817 B2
(45) Date of Patent: Jul. 7, 2020

(54) OVERDRIVE FOR ELECTRONIC DEVICE DISPLAYS

(71) Applicant: Apple Inc., Cupertino, CA (US)

(72) Inventors: Yingying Tang, Sunnyvale, CA (US); Chaohao Wang, Sunnyvale, CA (US); Sheng Zhang, Milpitas, CA (US); Yunhui Hou, San Jose, CA (US); Paolo Sacchetto, Cupertino, CA (US); Koorosh Aflatooni, Los Altos Hills, CA (US); Gokhan Avkarogullari, San Jose, CA (US); Guy Cote, Aptos, CA (US); Mahesh B. Chappalli, San Jose, CA (US); Peter F. Holland, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/146,910

(22) Filed: Sep. 28, 2018

(65) Prior Publication Data

US 2019/0122636 A1 Apr. 25, 2019

Related U.S. Application Data

(63) Continuation-in-part of application No. 15/967,892, filed on May 1, 2018.

(60) Provisional application No. 62/552,994, filed on Aug. 31, 2017.

(51) Int. Cl.

| | |
|---|---|
| ***G09G 5/10*** | (2006.01) |
| ***G09G 3/20*** | (2006.01) |
| ***G09G 3/3225*** | (2016.01) |
| ***G09G 3/36*** | (2006.01) |
| *G09G 3/3208* | (2016.01) |

(52) U.S. Cl.

CPC ..... *G09G 5/10* (2013.01); *G09G 3/2007* (2013.01); *G09G 3/3225* (2013.01); *G09G 3/3648* (2013.01); *G09G 3/3208* (2013.01); *G09G 3/3607* (2013.01); *G09G 2320/0242* (2013.01); *G09G 2320/0252* (2013.01); *G09G 2320/0285* (2013.01); *G09G 2320/103* (2013.01); *G09G 2340/16* (2013.01)

(58) Field of Classification Search

None

See application file for complete search history.

(56) References Cited

U.S. PATENT DOCUMENTS

| | | | | |
|---|---|---|---|---|
| 9,343,006 | B2 | 5/2016 | Li et al. | |
| 9,685,109 | B2 | 6/2017 | Kimpe et al. | |
| 9,741,282 | B2 | 8/2017 | Giannikouris et al. | |
| 2007/0285366 | A1* | 12/2007 | Ha | G09G 3/3648 345/87 |

(Continued)

*Primary Examiner* — Christopher J Kohlman

(74) *Attorney, Agent, or Firm* — Fletcher Yoder P.C.

(57) ABSTRACT

An electronic device is provided. The electronic device includes a display that is configured to show content that includes a plurality of frames. The plurality of frames includes a first frame that is associated with a pre-transition value. The plurality of frames also includes a second frame that is associated with a current frame value that corresponds to a first luminance. Additionally, the electronic device is configured to determine an overdriven current frame value corresponding to a second luminance that is greater than the first luminance. The electronic device is also configured to display the second frame using the overdriven current frame value.

20 Claims, 22 Drawing Sheets

(56) References Cited

U.S. PATENT DOCUMENTS

2017/0316727 A1 11/2017 Mizusako et al.

* cited by examiner

OVERDRIVE FOR ELECTRONIC DEVICE DISPLAYS

CROSS-REFERENCE TO RELATED APPLICATIONS

This application is a continuation-in-part of application Ser. No. 15/967,892, filed on May 1, 2018, which claims the benefit of U.S. Provisional Patent Application No. 62/552,994, filed Aug. 31, 2017, both of which are herein incorporated by reference in their entirety and for all purposes.

BACKGROUND

The present disclosure relates generally to display panels, and more specifically, to systems and methods that provide one or more frames of content with modified pixel settings.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In many devices, such as televisions, smartphones, computer panels, smartwatches, among others, pixel-based display panels are employed to provide a user interface. For example, in organic light emitting diode (OLED) panels, settings associated with pixels of display panels may change. For example, content being displayed on the screen may include frames that may differ from one another. In some instances, the initial response of the device to post-transition settings may not correspond to the post-transition settings. For example, content displayed on the display panels may be present for several frames before the content is displayed with visual characteristics that correspond to the post-transition settings.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In many devices, such as televisions, smartphones, computer panels, smartwatches, among others, pixel-based display panels are employed to display content. For example, organic light emitting diode (OLED) panels may be used. In some instances, the initial response of the device to post-transition settings may not correspond to the post-transition settings. As a result, the content may be displayed for several frames before the content is displayed with the post-transition settings. Embodiments described herein discuss techniques that enable one or more frames of the content to be displayed in a manner that more closely corresponds to the post-transition settings.

In one embodiment, an electronic device that includes a display is provided. The display is configured to show content that includes a plurality of frames, and the plurality of frames includes a first frame that is associated with a pre-transition value. The plurality of frames also includes a second frame that is associated with a current frame value that corresponds to a first luminance. Additionally, the electronic device is configured to determine a compensated current frame value corresponding to a second luminance. The electronic device is also configured to display the second frame using the compensated current frame value.

In another embodiment, a method includes determining a pre-transition value associated with a first frame of content and determining a post-transition value associated with a second frame of content and a first luminance. The method also includes determining an overdrive value associated with the second frame. The overdrive value is associated with a second luminance that is greater than the first luminance. The method also includes displaying the second frame using the overdrive value.

In a further embodiment, an electronic device includes a display that is configured to show content. The content includes a first set of frame data that includes a pre-transition value. The content also includes a second set of frame data that includes a post-transition value associated with a first luminance. Moreover, the electronic device is configured to determine an overdrive value based on the pre-transition value and post-transition value, wherein the overdrive value is associated with a second luminance that is greater than the first luminance. The electronic device is also configured to generate a third set of frame data that includes the overdrive value. Additionally, the electronic device is configured to display a first frame associated with the first set of frame data; and a second frame associated with the third set of frame data.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Many electronic devices may use display panels to show content to users. Many user display panels may be pixel-based panels, such as light-emitting diode (LED) panels, organic light emitting diodes (OLED) panels and/or plasma panels. In many devices, such as televisions, smartphones, computer panels, smartwatches, among others, pixel-based display panels are employed to show content and/or provide a user interface. For example, content may include frames that can be displayed. One frame may include pre-transition settings, while a subsequent frame may include post-transition settings. In some instances, the initial response of the display to post-transition settings may not correspond to the post-transition settings. For example, the post-transition settings may be associated with color and/or brightness settings that differ from those associated with the pre-transition settings. Indeed, content displayed on the display panels may be present for several frames before the content is displayed with visual characteristics that correspond to the post-transition settings.

Embodiments described herein are related to system and methods for providing improved initial responses. More specifically, the present disclosure discusses an overdrive technique that may be used to modify one or more frames of the content such that the initial frame response more closely corresponds to post-transition settings.

Figure 1:
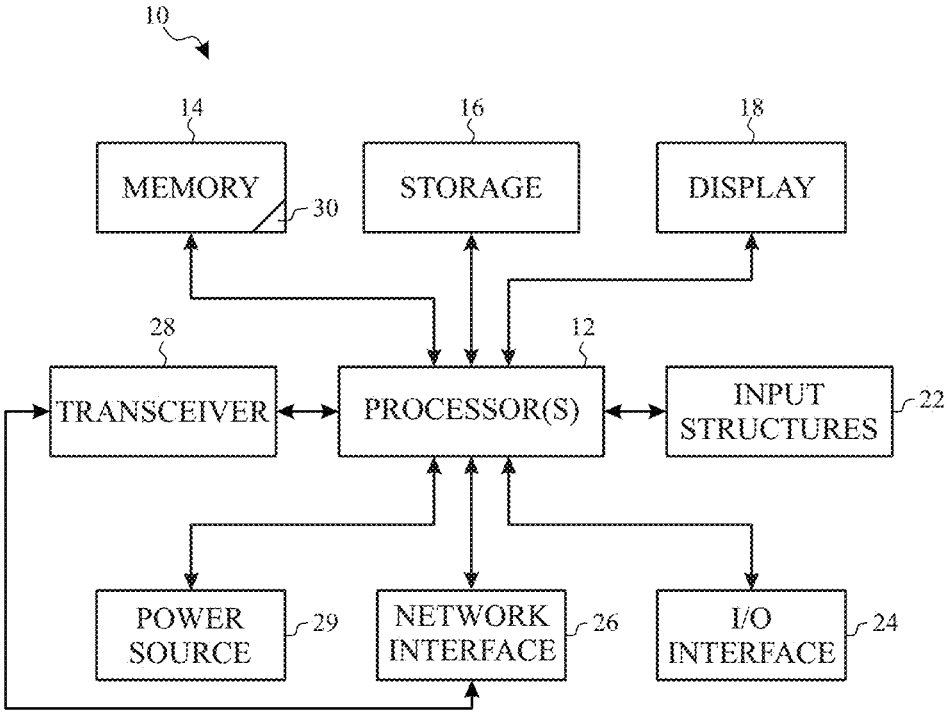
FIG. 1 is a schematic block diagram of an electronic device, in accordance with an embodiment.

With the foregoing in mind, a general description of suitable electronic devices that may employ an overdrive to provide an improved response to changed display settings is discussed herein. Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, a transceiver 28, and a power source 29. The various functional blocks shown in FIG. 1 may include hardware elements (including circuitry), software elements (including computer code stored on a computer-readable medium) or a combination of both hardware and software elements. For example, as discussed in greater detail below, the memory 14 may include software instructions associated with an overdrive 30 that when executed by the one or more processors 12 cause a portion of the display 18 to be commanded to have certain characteristics that differ from an intended set of characteristics. It should be noted that FIG. 1 is merely one example of a particular implementation and is intended to illustrate the types of components that may be present in electronic device 10. For example, in some embodiments, the overdrive 30 may be performed by overdrive circuitry separate from the memory 14 and/or processor(s) 12. In other embodiments, the electronic device 10 may not include the display 18, but may be communicatively coupled another electronic device that includes a display, such as a television.

Figure 2:
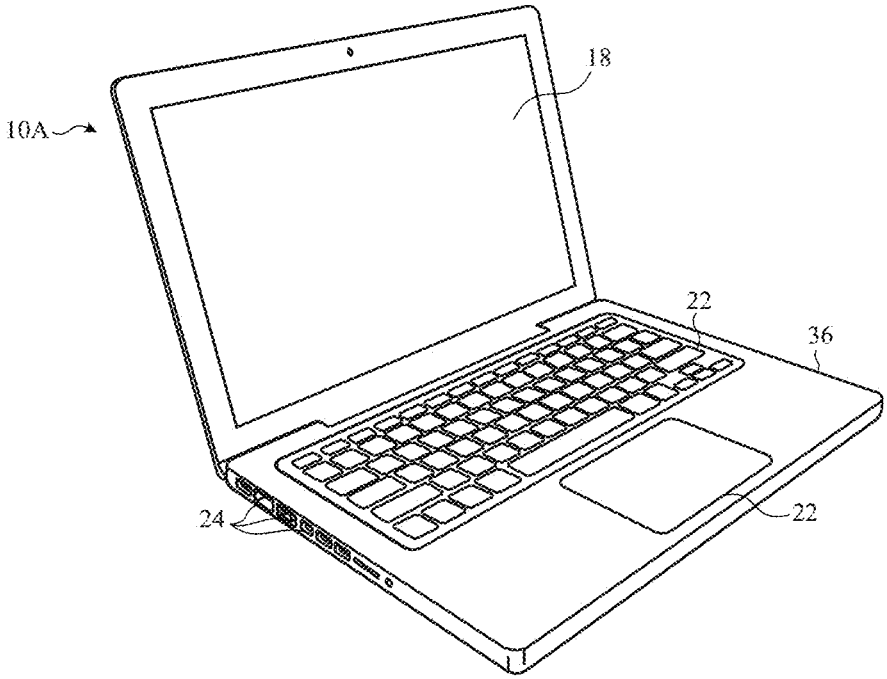
FIG. 2 is a perspective view of a notebook computer representing an embodiment of the electronic device of FIG. 1, in accordance with an embodiment.
Figure 3:
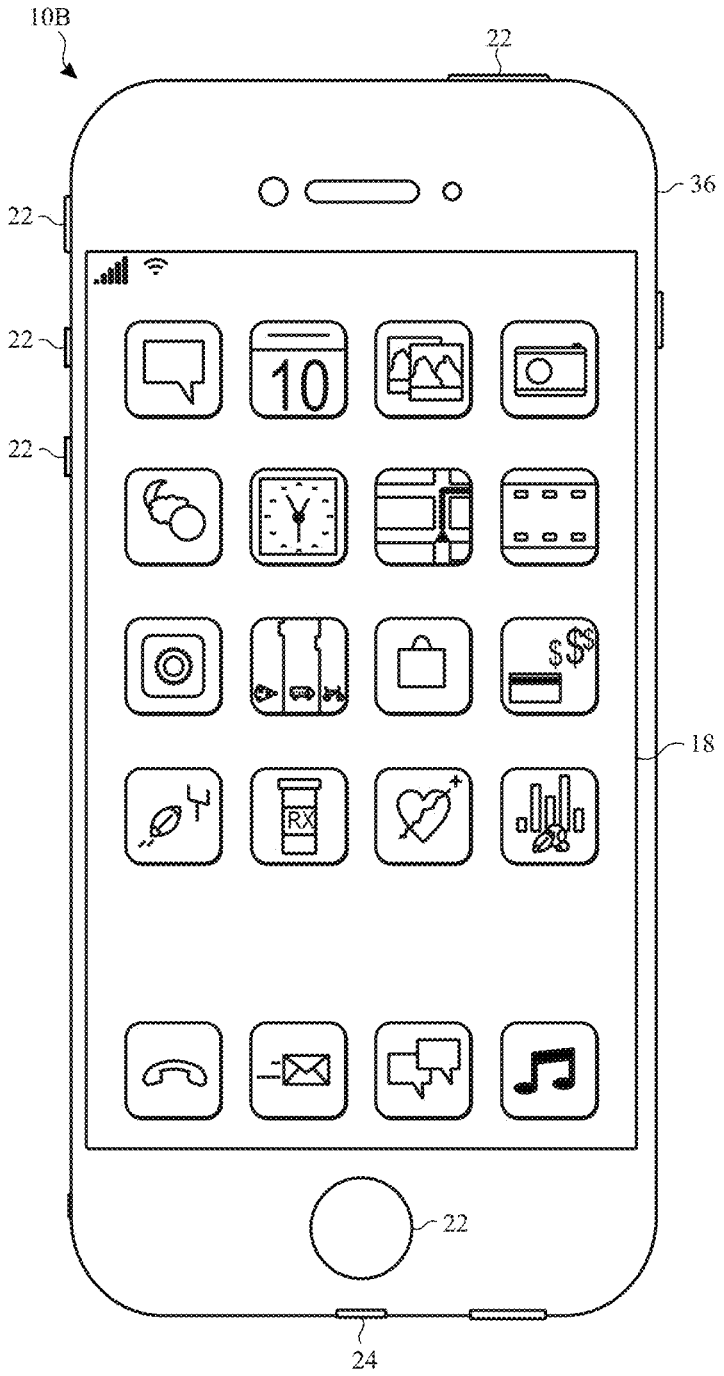
FIG. 3 is a front view of a hand-held device representing another embodiment of the electronic device of FIG. 1, in accordance with an embodiment.
Figure 4:
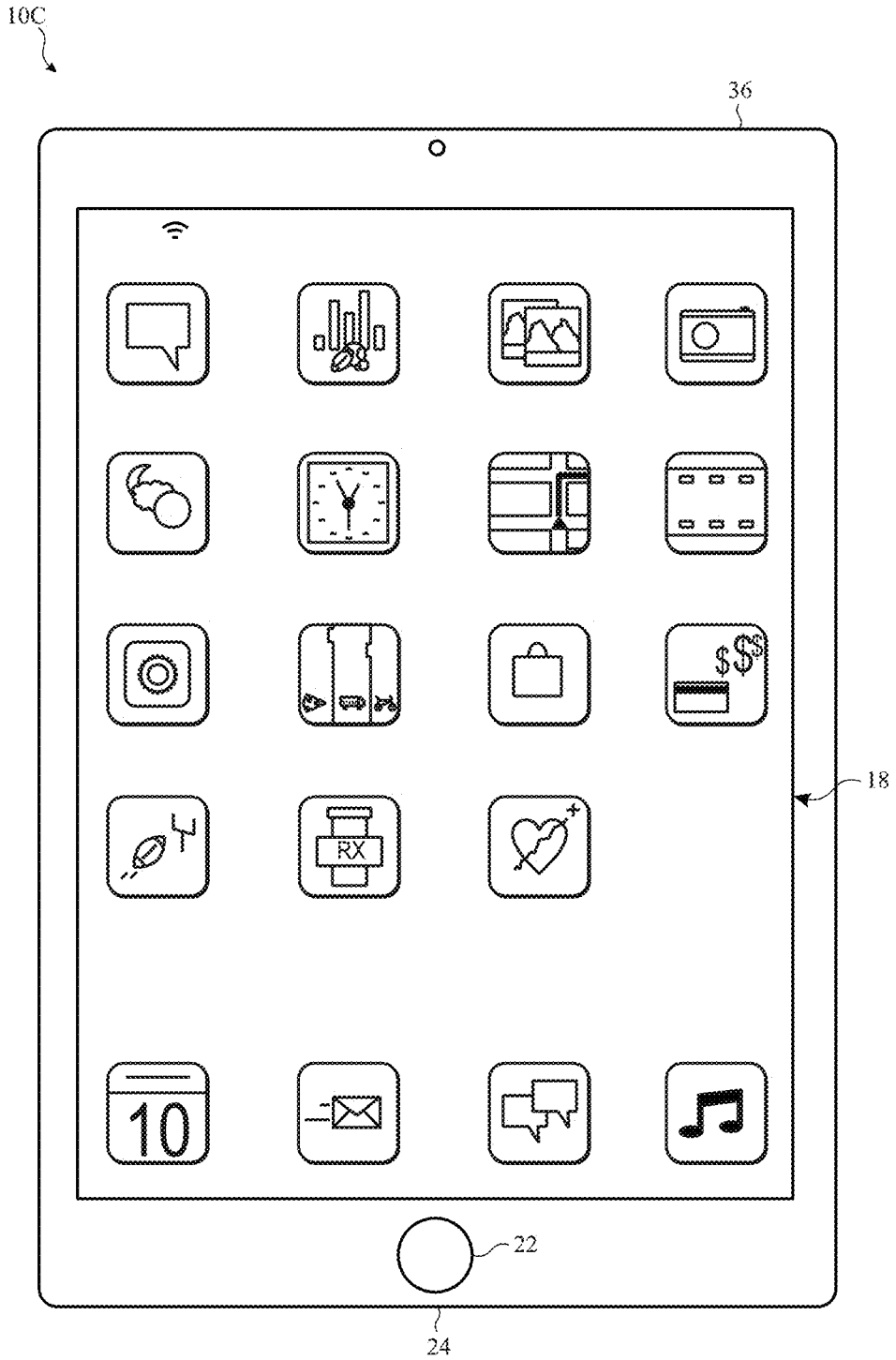
FIG. 4 is a front view of another hand-held device representing another embodiment of the electronic device of FIG. 1, in accordance with an embodiment.
Figure 5:
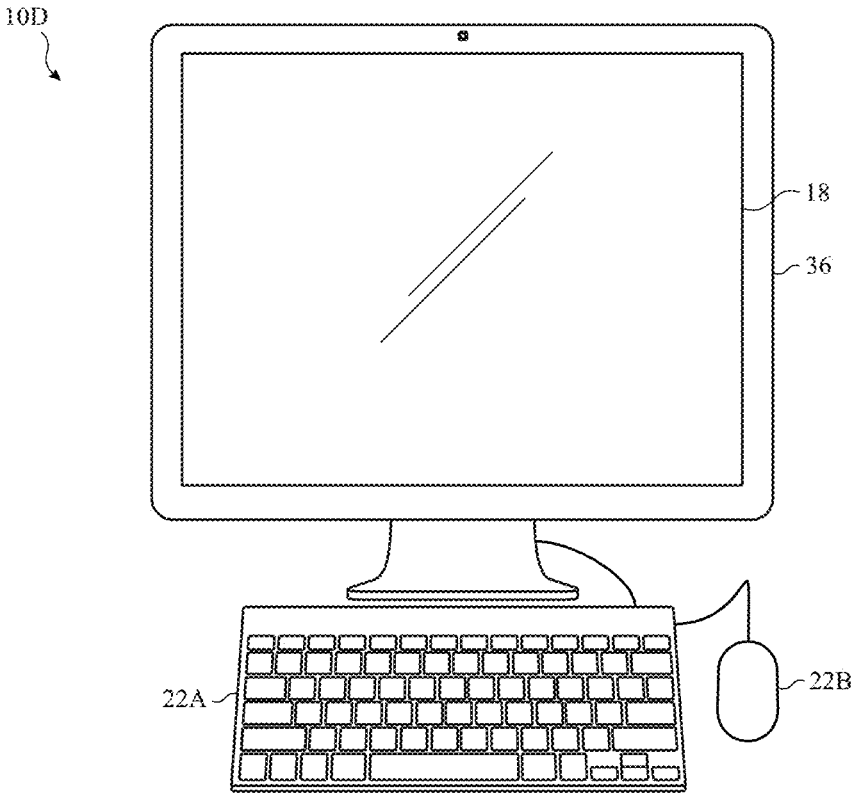
FIG. 5 is a front view of a desktop computer representing another embodiment of the electronic device of FIG. 1, in accordance with an embodiment.
Figure 6:
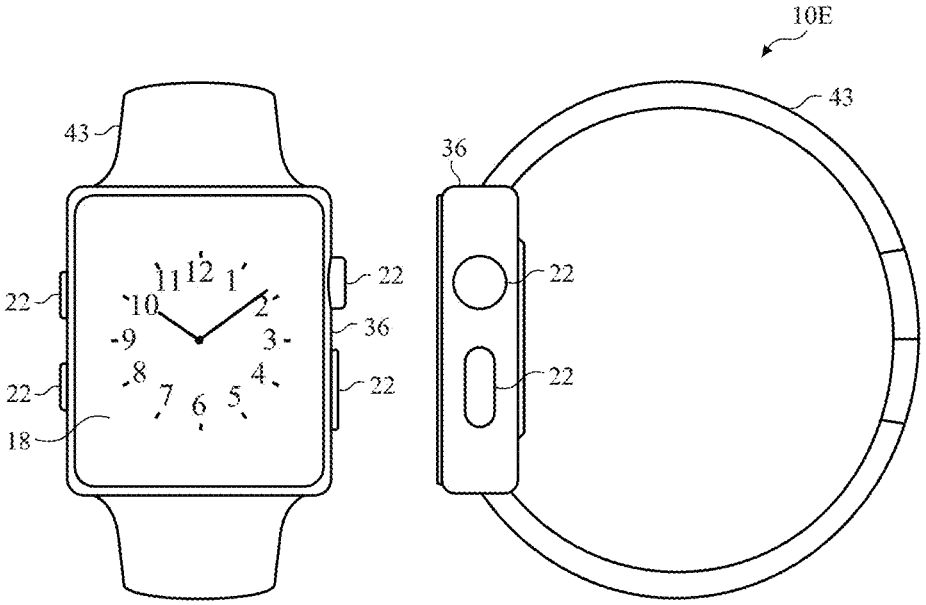
FIG. 6 is a front view and side view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry". Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor (s) 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of liquid crystal display (LCD) panels and OLED panels. The display 18 may receive images, data, or instructions from processor 12 or memory 14, and provide an image in display 18 for interaction. More specifically, the display 18 includes pixels, and each of the pixels may be set to display a color at a brightness based on the images, data, or instructions from processor 12 or memory 14. For instance, the colors displayed by the pixels may be defined by a RGB color model wherein each pixel displays a color based on a value for how much red, green, and blue is included in the color. For example, the color black may be defined as "RGB: 0, 0, 0," the color white may be defined as "RGB: 255, 255, 255," and all other colors may be defined by various combinations of red, green, and blue that have values between 0 and 255 (e.g., yellow may be defined as "RGB: 255, 255, 0"). Hexadecimal numbers may be used instead of decimal numbers. Additionally, colors may also be defined as coordinates of a color space. For example, colors may be defined by a set of coordinates in RGB color spaces such as standard Red Green Blue ("sRGB") as described in International Electrotechnical Commission standard 61966-2-1:1999 and/or DCI-P3 as described by the Society of Motion Picture and Television Engineers (SMPTE) in SMPTE ED 432-1:2006 and SMPTE RP 431-2:2011.

In some instances, such as when pixels change from one setting to another (e.g., a change in color and/or brightness), content displayed on some of the pixels of the display 18 may initially differ from settings at which the content should be displayed. For example, based on received images, data, or instructions from the processor 12 and/or memory 14, some pixels of the display 18 may be caused to transition from a green value of 0 (i.e., no green) to a higher value (e.g., 200). However, in some cases, the color displayed on such pixels of the display 18 may not initially be the higher value. For example, it may take one or more frames for pixels to display the color and/or brightness that should be displayed. As discussed below, the memory 14 may include instructions pertaining to an overdrive 30, and the overdrive 30 causes the first frame or several frames of pixels to be commanded to display a color and/or brightness that differs from the intended color and/or brightness so that the pixels of the display 18 have the intended settings or settings that are similar to the intended settings at the first frame.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, 4th generation (4G) cellular network, long term evolution (LTE) cellular network, or long term evolution license assisted access (LTE-LAA) cellular network. The network interface 26 may also include one or more interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth.

In certain embodiments, to allow the electronic device 10 to communicate over the aforementioned wireless networks (e.g., Wi-Fi, WiMAX, mobile WiMAX, 4G, LTE, and so forth), the electronic device 10 may include a transceiver 28. The transceiver 28 may include any circuitry that may be useful in both wirelessly receiving and wirelessly transmitting signals (e.g., data signals). Indeed, in some embodiments, as will be further appreciated, the transceiver 28 may include a transmitter and a receiver combined into a single unit, or, in other embodiments, the transceiver 28 may include a transmitter separate from the receiver. For example, as noted above, the transceiver 28 may transmit and receive OFDM signals (e.g., OFDM data symbols) to support data communication in wireless applications such as, for example, PAN networks (e.g., Bluetooth), WLAN networks (e.g., 802.11x Wi-Fi), WAN networks (e.g., 3G, 4G, and LTE cellular networks), WiMAX networks, mobile WiMAX networks, ADSL and VDSL networks, DVB-T and DVB-H networks, UWB networks, and so forth. Further, in some embodiments, the transceiver 28 may be integrated as part of the network interfaces 26. As further illustrated, the electronic device 10 may include a power source 29. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. Enclosure 36 may also include sensing and processing circuitry that may be used to provide correction schemes described herein to provide smooth images in display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

In some embodiments, the electronic device 10 may be communicatively coupled to another electronic device that includes a display. For example, the electronic device 10 may include a digital media player and entertainment console that may be used to receive content, such as digital video data, from a number of sources and stream the content via a television. For instance, in one or more embodiments, the electronic device 10 may be an Apple TV® console available from Apple Inc.

Figure 7:
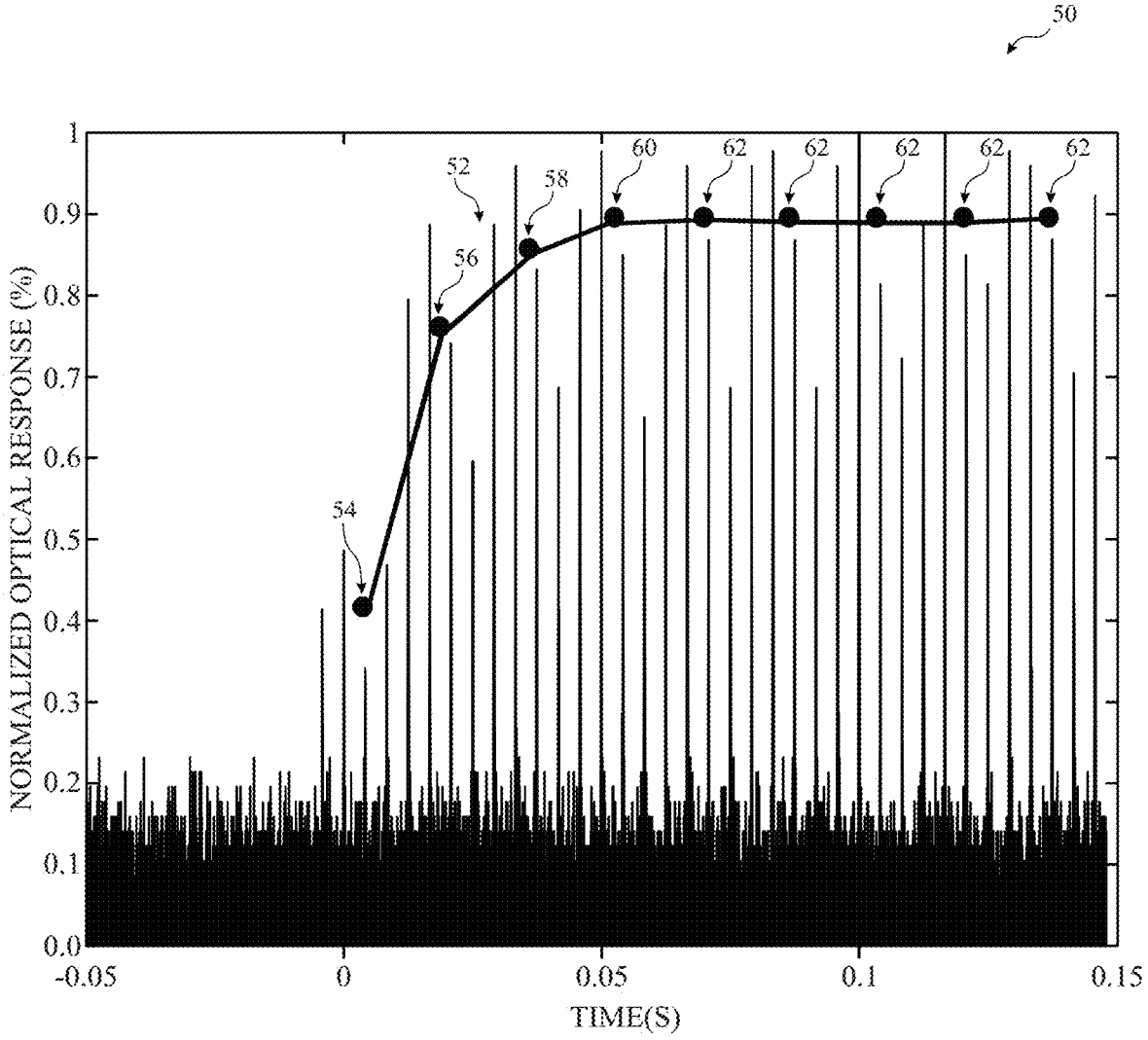
FIG. 7 is a graph depicting normalized optical response over time of a transition from green 0 to green 255 at a luminance of 2 nits, in accordance with an embodiment.

With the foregoing in mind, FIG. 7 is a graph 50 depicting normalized optical response over time of a transition from green 0 to green 255 at 2 nits (i.e., at 2 candelas per square meter) of the display 18. The graph also includes a line 52 showing the normalized optical response of various frames. As discussed above, in some instances when pixels change from one setting to another (e.g., a change in color), the content displayed on some of the pixels of the display 18 may initially differ from settings at which the content should be displayed. For example, as illustrated, the normalized optical responses of a first frame 54, second frame 56, and third frame 58 are lower than that of a fourth frame 60 and subsequent frames 62. In other words, when some pixels of the display 18 transition from green 0 to green 255, green 255 is not displayed until the fourth frame 60. Moreover, while the data shown in FIG. 7 was recorded at a brightness of 2 nits, it should be noted that dimmed frames (e.g., the first, second, and third frames 54, 56, 58) may occur at other brightness settings of the display 18 (e.g., a brightness lower than 2 nits or greater than 2 nits, such as 8 nits).

Figure 8:
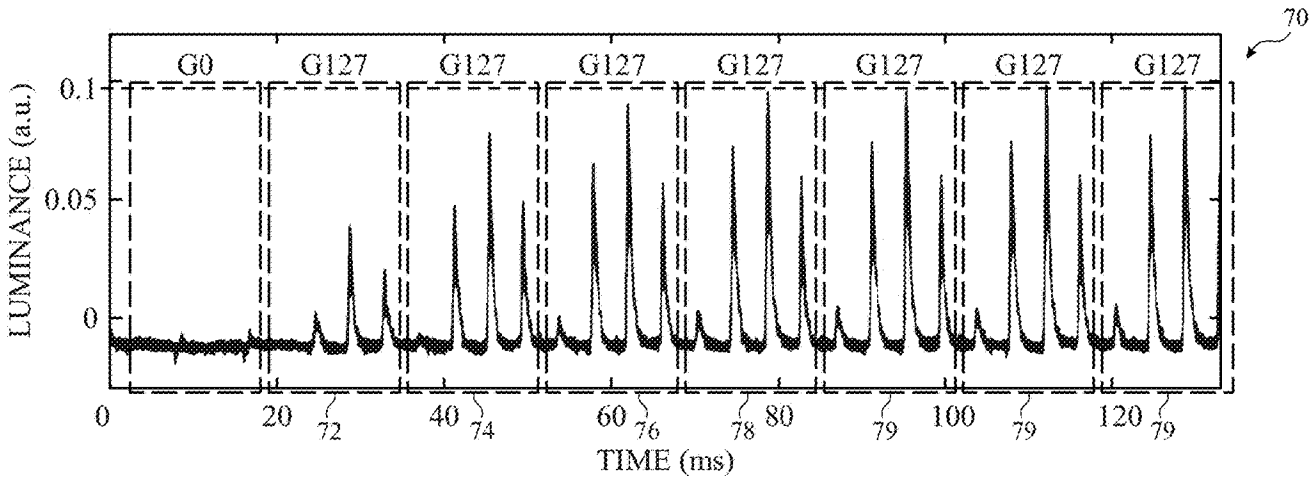
FIG. 8 is a graph of luminance over time for a transition from green 0 to green 127, in accordance with an embodiment.

As another example of this phenomenon, FIG. 8 shows a graph 70 of luminance over time for a transition from green 0 to green 127. The graph 70 also includes values of the amount of green that is supposed to be displayed at a given time. That is, these values of the amount of green correspond to the images, data, or instructions from processor 12 or memory 14 that are shown on the display 18. As illustrated, during the transition from green 0 to green 127, a first frame 72, second frame 74, and third frame 76 have a luminance that is lower than the luminance of a fourth frame 78. The data associated with the fourth frame 78 (and subsequent frames 79) show green 127 being displayed, while the data associated with the first frame 72, second frame 74, and third frame 76 show a value of green that is less than green 127.

Figure 9:
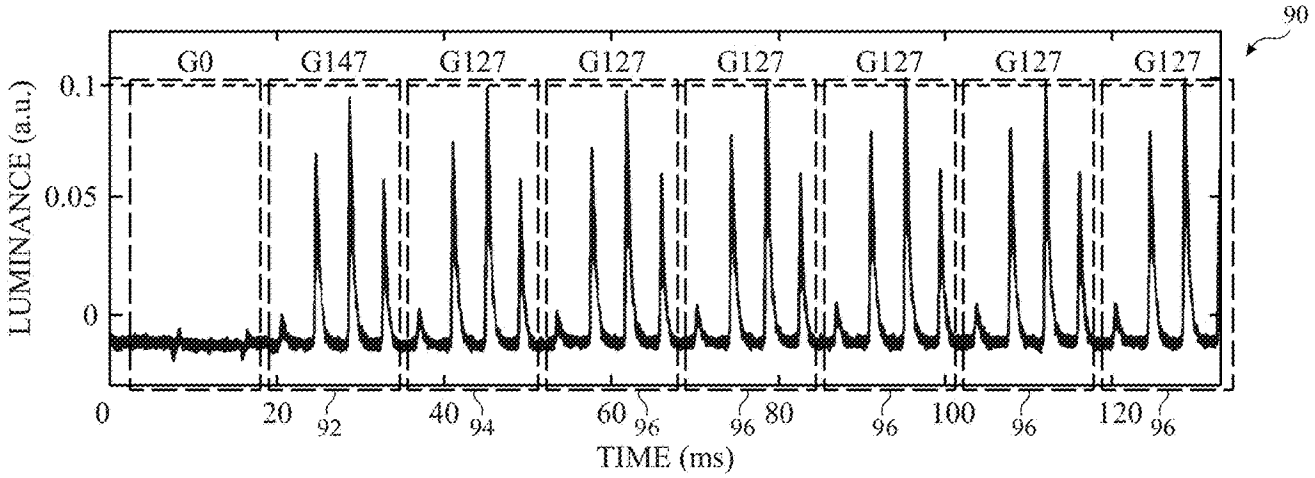
FIG. 9 is a graph of luminance over time of a transition from green 0 to green 127 that includes an overdriven first frame, in accordance with an embodiment.

With the discussion of FIG. 7 and FIG. 8 in mind, FIG. 9 is a graph 90 of luminance over time of a transition from green 0 to green 127 that includes a first frame 92 that has an elevated green value. The elevated green value is achieved via implementation of the overdrive 30. In other words, when pixels of the display 18 are to transition from green 0 to green 127, the execution of the overdrive 30 may cause one or more of the processors 12 (e.g., a graphics processing unit (GPU)) to instruct the display 18 to show a value of green (e.g., green 147) that is higher than a target value (i.e., green 127). As illustrated, the overdrive 30 takes effect for the first frame 92. That is, the display 18 is instructed to display green 147 for one frame. Subsequent frames, such second frame 94 and subsequent frames 96, are instructed to display the target value of green 127. As can be seen from comparing graph 70 and graph 90 to one another, execution of the overdrive 30 results in a first frame (e.g., frame 92) that is closer to green 127 than the first frame 72 of graph 70. In other words, by providing a compensated pixel value (e.g., an overdrive pixel value that is higher than the target pixel value and/or an underdrive pixel value that is lower than the target pixel value), the transition speed from the first pixel value to the target pixel value is increased, causing the display 18 to have a first frame that has color settings that are more similar to the target values.

Figure 10:
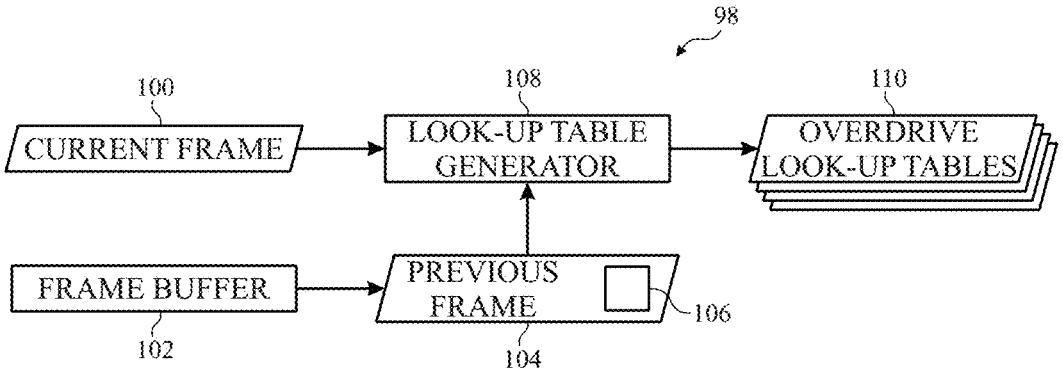
FIG. 10 is a data flow chart of a process for generating a first set of overdrive look-up tables, in accordance with an embodiment.
Figure 11:
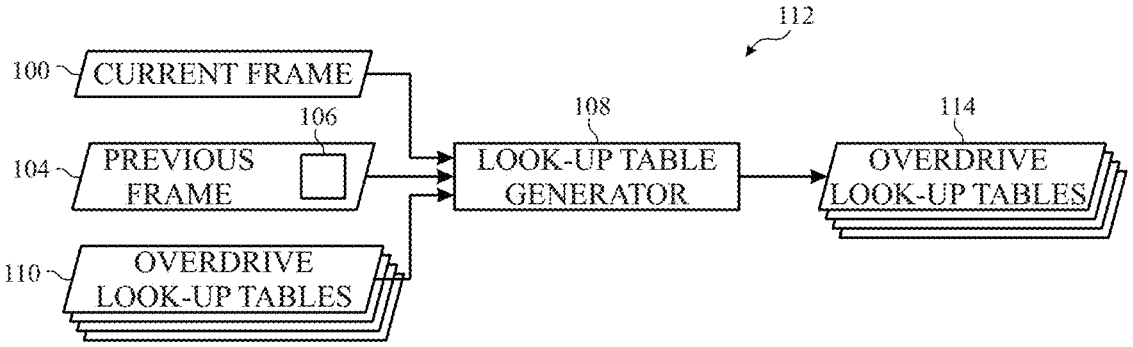
FIG. 11 is a data flow chart of a process for generating a second set of overdrive look-up tables, in accordance with an embodiment.
Figure 12:
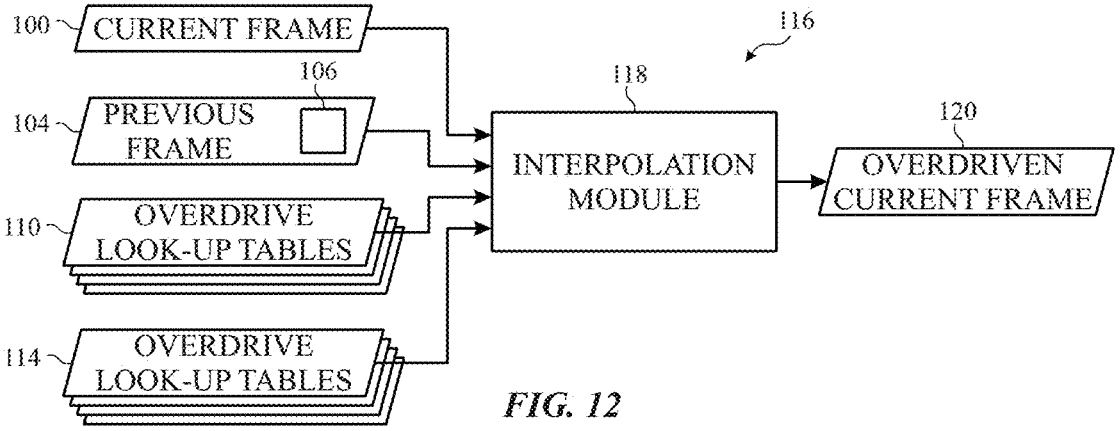
FIG. 12 is a data flow chart of a process for generating an overdriven current frame, in accordance with an embodiment.

Before proceeding a more detailed discussion of the overdrive 30, it should be noted that while FIGS. 7-9 related to values of green, this is only one example. Indeed, the overdrive 30 is not limited to values of green. That is, the overdrive 30 may be utilized to modify values of red, green, blue, and any combination thereof. Moreover, it should be understood that the discussion below relating to FIGS. 10-12 is provided as an overview of various processes that may be performed by the one or more processors 12 during execution of the overdrive 30. A more detailed discussion relating to the processes and overdrive 30 is provided thereafter.

FIG. 10 is a data flow chart of a process 98 for generating a first set of overdrive look-up tables. The overdrive look-up tables may be used to determine overdrive pixel values that may be used to increase transition speed to the target pixel value. As used herein, and unless indicated otherwise, "current frame" refers to a frame to be displayed, and "previous frame" refers to the frame directly preceding the current frame. Keeping this in mind, current frame data 100 may include information regarding display settings and content to be shown on the display 18. For example, the current frame data 100 may include RGB color data, brightness settings, and temperature information. The current frame data 100 may be sent to a frame buffer 102. The frame buffer 102, which may also receive previous frame data 104, may determine region(s) 106 that differ between the current frame and the previous frame. For example, the region(s) 106 may be one or more regions of pixels of the display 18 that have different settings defined by the current frame data 100 and the previous frame data 104.

The current frame data 100 and previous frame data 104 may be utilized by a look-up table generator 108, which may generate a set of overdrive look-up tables 110 based on the current frame data 100 and the previous frame data 104. The overdrive look-up tables 110, which are discussed in more detail below, include information regarding RGB color settings, brightness settings, and temperature values for each pixel of the display 18. For example, in some embodiments, the first set of overdrive look-up tables 110 may include a look-up table for each color (e.g., red, green, and blue), a screen brightness (i.e., luminance), and temperature, and the overdrive look-up tables 110 may include values of settings are utilized during execution of the overdrive 30. More detail regarding the first set of overdrive look-up tables 110 is provided below.

As will be discussed in more detail below, in some embodiments, it may be beneficial to use more than one set of overdrive tables to determine the overdrive. For example, two or more sets of overdrive tables may be used to determine overdrive values for pixel values. FIG. 11 is a data flow chart of a process 112 for generating a second set of overdrive look-up tables. During the process 112, the current frame data 100, previous frame data 104, and first set of overdrive look-up tables 110 may be sent to the look-up table generator 108. The look-up table generator 108 may then generate a second set of overdrive look-up tables 114 based on the current frame data 100, previous frame data 104, and the first set of overdrive look-up tables 110. Similar to the first set of overdrive look-up tables 110, the second set of overdrive look-up tables includes information regarding display settings such as RGB color settings, brightness settings, and temperature values.

FIG. 12 is a data flow chart of a process 116 for generating an overdriven current frame. The current frame data 100, previous frame data 104, first set of overdrive look-up tables 110, and second set of overdrive look-up tables 114 may be utilized by an interpolation module 118, which may generate an overdriven current frame 120. For example, the interpolation module may perform linear interpolations of the current frame data 100 and/or previous frame data 104 using the first set of overdrive look-up tables 110 and, in some embodiment, the second set of overdrive look-up tables 114. The overdriven current frame 120 is a frame that is generated upon execution of the overdrive 30. That is, the overdriven current frame 120 is a frame that may be commanded to color and/or brightness settings that differ from the settings associated with the current frame. For instance, and as discussed above, frames generated via implementation of the overdrive 30 may have elevated color values compared to color values associated with the current frame. For instance, the current frame may call for green 127, but the overdriven current frame 120 may call for green 147 to be displayed so that the luminance of the display 18 of the first frame displayed is closer to green 127.

It should be noted that the overdrive 30 and the processes 98, 112, and 116 may be performed solely on pixels associated with the region(s) 106. In other words, in some embodiments, the overdrive 30 may be applied to only pixels that differ between the current frame and the previous frame. This may result in additional processing efficiencies, as unchanged pixels are not included in the overdrive calculation and processing.

Additionally, other calculations may be performed during the processes 98, 112, and 116. For example, the current frame data 100 and previous frame data 104 may be linearized. The current frame data 100 and previous frame data 104 may also be multiplied by a matrix (e.g., a 3×3 matrix) to get corresponding values (e.g., RGB color values) that filter out environmental lighting.

Figure 13:
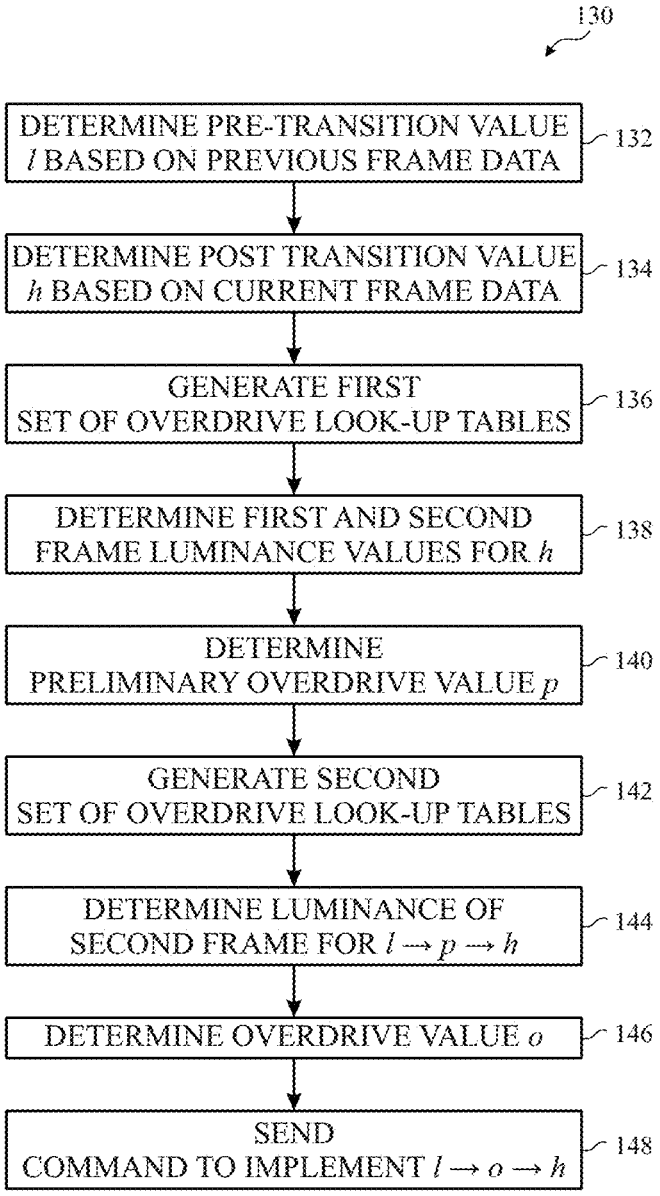
FIG. 13 is a flow chart of a method for implementing an overdrive, in accordance with an embodiment.

FIG. 13 is a flow chart of a method 130 for implementing the overdrive 30. The method 130 may be performed by the one or more processors 12 or other circuitry. Furthermore, while the method 130 describes steps in a certain order, it should be noted that the method 130 may be performed in an order that differs from the order described below.

At block 132, a pre-transition value, l, may be determined based on the previous frame data 104. For example, the value of l may be defined in the previous frame data 104. For instance, in a transition from green 0 to green 200, l may be defined as green 0.

At block 134, a post-transition value, h, may be determined based on the current frame data 100. The value of h may be greater than or lower than the value of l. For example, the value of h may be defined by the current frame data 100. Continuing with the example of a transition from green 0 to green 200, the value of h may be defined as green 200.

At block 136, the first set of overdrive look-up tables 110 may be generated. Many calculations may be undertaken in the generation of the overdrive look-up tables 110. For example, luminance values associated with l, h, and values greater than l (when l is greater than h) and/or values that are lower than l (when l is lower than h) may be determined, and such values may be stored in the overdrive look-up tables 110. For instance, the luminance values may be luminance values at different frames for any value greater than l and/or lower than l. Continuing with the example of a transition from green 0 to green 200, the luminance of the first and second frames of displaying green 1 to green 255 may be determined and stored in the overdrive look-up tables 110. In some embodiments, the overdrive look-up tables 110 may not include each luminance value for values between l and h. Additionally, the overdrive look-up tables 110 may be generated for each color (e.g., red, green, and blue), various brightness levels of the display 18, and temperature.

At block 138, the first and second frame luminance values for h may be determined. This determination may be made by looking up luminance values in the overdrive look-up tables 110.

At block 140, a preliminary overdrive value, p, may be determined based on the second frame luminance value of h. More specifically, the value of p is such that the first frame luminance associated with p is approximately equal to the second frame luminance associated with h. In other words, p may be determined by using the overdrive look-up tables 110 to find which value that is greater than h has a first frame luminance that is approximately equal to the second frame luminance associated with h.

At block 142, the second set of overdrive look-up tables 114 may be generated. The overdrive look-up tables 114 may also include luminance values for a transition from l to p to h (i.e., the first frame corresponds to p and the second frame corresponds to h. In other words, the overdrive look-up tables 114 may include values relating to luminance associated with each of l, p, h, or a combination thereof. The overdrive look-up tables 114 may also be generated for each color (e.g., red, green, and blue), various brightness levels of the display 18, and temperature.

At block 144, a luminance of a second frame for a transition from l to p to h may be determined. In other words, in a transition from a pre-transition from associated with l to a first frame with value p and a second transition from the first frame to a second frame with value h, a luminance of the display 18 may be determined. This determination may be made by finding the luminance value in the overdrive look-up tables 114.

At block 146, an overdrive value, o, may be determined based on the second frame luminance value associated with the transition from l to p to h. More specifically, the value of o is such that the first frame luminance of o is approximately equal to the second frame luminance value of o. In other words, o may be determined by using the overdrive look-up tables 114 to find which value that is greater than p has a first frame luminance that is approximately equal to the second frame luminance of h.

At block 148, a transition from l to o to h may be implemented. For example, the one or more processors 12 may send a command that causes pixels of the display 18 to switch from having display settings with value l to value o in the transition from a pre-transition frame to a first frame, and from having display settings with value o to settings with value h in the transition from the first frame to the second frame. In such a scenario, o may be considered a compensated value in the sense that by implementing a transitions from l to o to h, display settings with value o associated with a first frame may appear more closely to display settings associated with h at a subsequent frame.

Keeping the discussion of FIGS. 10-13 in mind, FIGS. 14-17 are provided to further illustrate how the overdrive 30 may be performed. More specifically, FIGS. 14-17 illustrate an example of a transition from a gray level of 0 ("G0") to a gray level of 159 ("G159"). In other words, in the example discussed in relation to FIGS. 14-17, G0 is l, and G159 is h. Gray levels, which refer to grayscale values associated with color settings, may be determined based on data such as the current frame data 100 and previous frame data 104. For instance, the grayscale values may be based on linearized current frame data 100 and the previous frame data 104. It should also be noted that grayscale values may be determined for each pixel as a whole (i.e., as a combination of RGB color settings), or for each color component of a pixel (e.g., one grayscale value for a red value, one grayscale value of the green value, and one grayscale value for a blue value).

Figure 14:
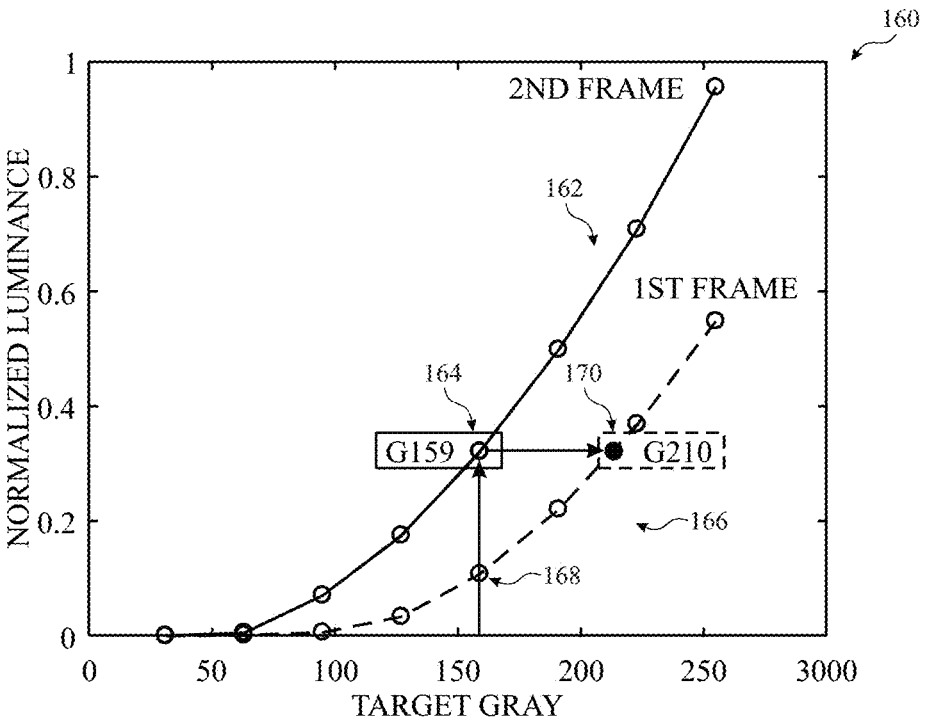
FIG. 14 is a graph of a target gray values and normalized luminance at 4 nits, in accordance with an embodiment.

FIG. 14 is a graph 160 of target gray values and normalized luminance at a brightness of 4 nits. A first line 162 illustrates luminance values associated with the second frame in the transition from G0 to various gray values. A point 164 along the first line 162 corresponds to a luminance value associated with G159 at the second frame. To analogize the transition using the format discussed above, the transition is G0 to another gray level, wherein the pre-transition frame has a gray level of G0, and all subsequent frames are commanded to have a constant gray level. For example, the point 164 is indicative of a luminance associated with the second frame in a transition from G0 to G159.

The graph also include a second line 166 that shows luminance values associated with the first frame in a transition from G0 to other gray levels. For instance, a point 168 corresponds to a luminance associated with the first frame in a transition from G0 to G159, while another point 170 corresponds to a luminance associated with the first frame in a transition from G0 to G210. As illustrated, the luminance associated with the first frame in a transition from G0 to G210 is equal to the luminance associated with the second frame in a transition from G0 to G159. In other words, G210 is p.

Figure 15:
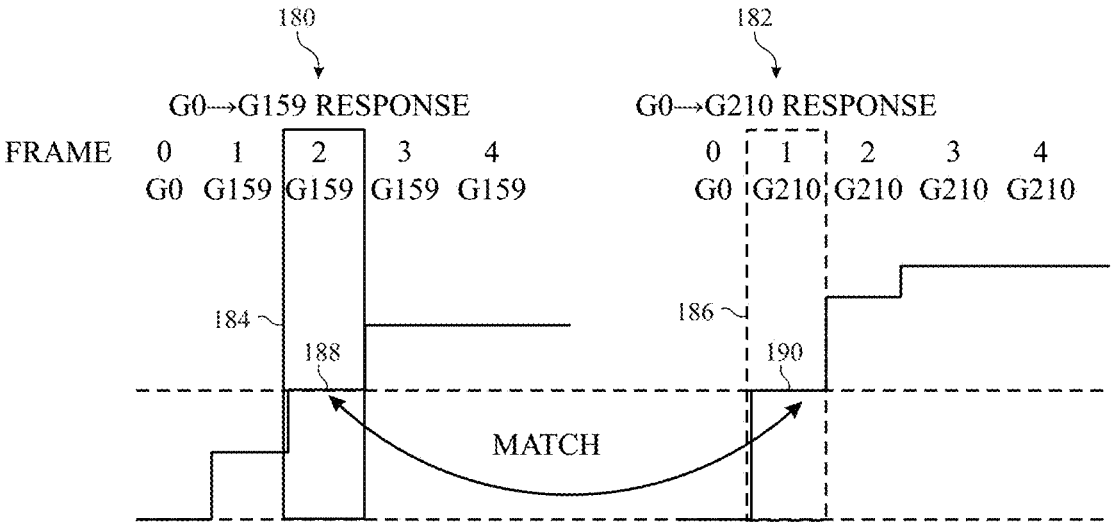
FIG. 15 illustrates two graphs that respectively show relative luminance values associated with transitions from G0 to G159 and G0 to G210, in accordance with an embodiment.

FIG. 15 includes graphs 180 and 182, which respectively show relative luminance values associated with transitions from G0 to G159 and G0 to G210. A second frame 184 associated with the transition from G0 to G159 and a first frame 186 associated with a transition from G0 to G210 respectively correspond to the points 164 and 166 of FIG. 14. A luminance 188 associated with the second frame 184 and a luminance 190 associated with the first frame 186 are also shown. As illustrated, the luminance 188 and the luminance 190 are equivalent.

FIGS. 14 and 15 are provided to graphically show the relationship between l, p, and h. As noted above, the value of p can be determined based on values stored in the first set of overdrive look-up tables 110. As also described above, the values stored in the first set of overdrive look-up tables 110 (as well as the second set of overdrive look-up tables 114) may be determined for each color component (e.g., red, green, and blue), brightness, and temperature.

Figure 16:
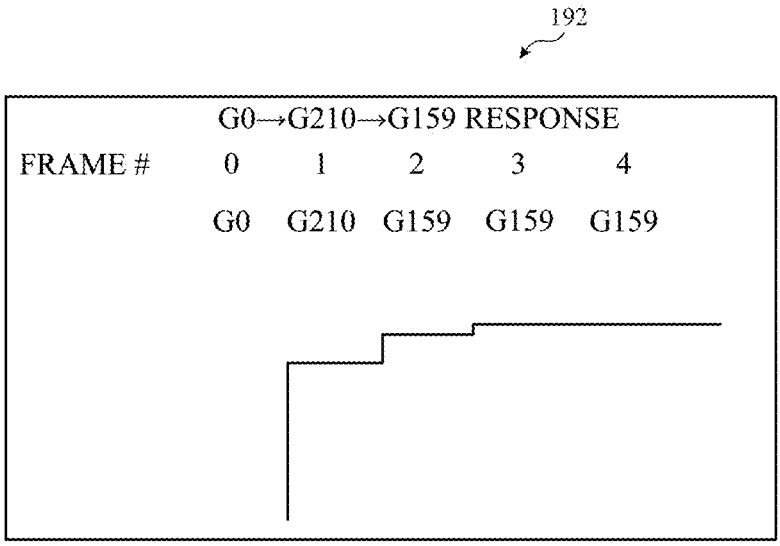
FIG. 16 is a graph illustrating luminance values of associated with frames in a transition from G0 to G159, in accordance with an embodiment.

FIG. 16 is a graph 192 illustrating luminance values of a transition from G0 to G159 in which the first frame is commanded to display G210. In other words, FIG. 16 shows a transition from G0 at a pre-transition frame to G210 at a first frame to G159 at a second and subsequent frames. The graph 192 is also representative of a transition of l to p to h for a transition from G0 to G159, with G210 being p. As can be seen from comparing the graph 192 to graph 180, there is a higher luminance associated with the first frame in the G0 to G210 to G159 transition than in the transition from G0 to G159. Additionally, as described above, the second set of overdrive look-up tables 114 may be determined based on the first set of overdrive look-up tables 110, which may include luminance values associated with various frame settings, such as color, brightness, and temperature.

Figure 17:
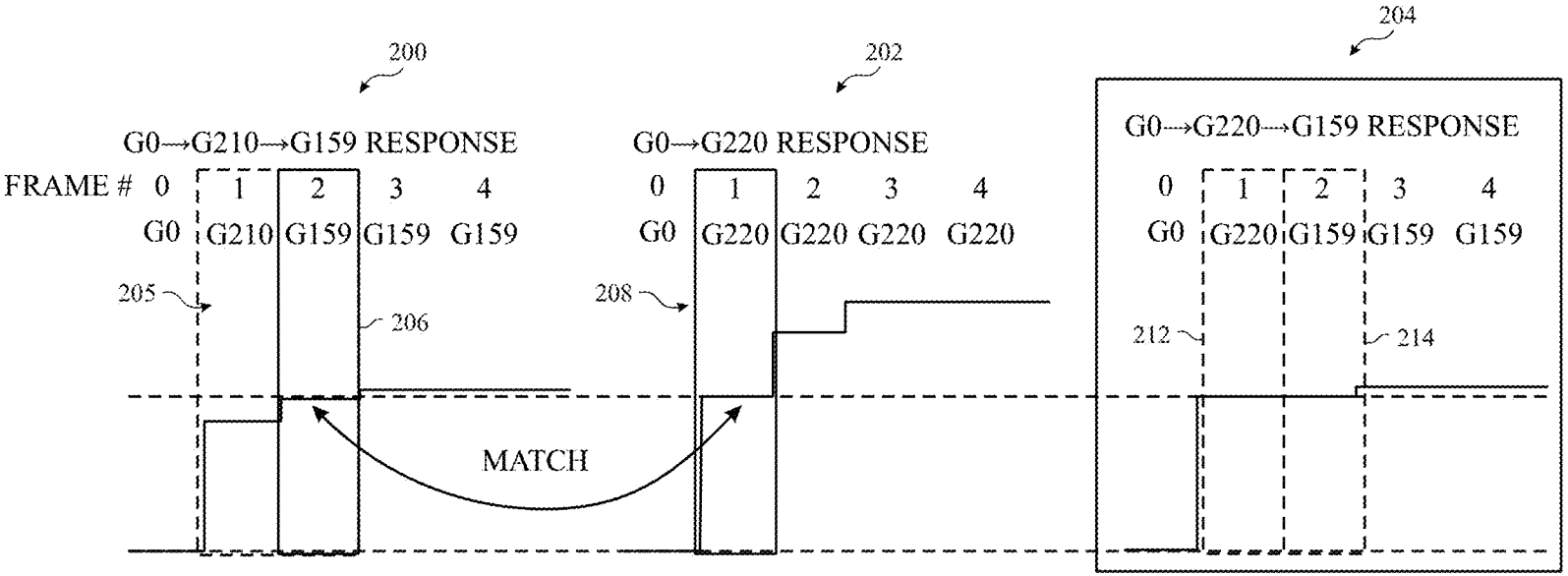
FIG. 17 illustrates graphs showing relative luminance levels associated with frames in three different transitions, in accordance with an embodiment.

FIG. 17 pertains to the overdrive value, o. More specifically, FIG. 17 illustrates graphs 200, 202, and 204, which each show relative luminance levels associated with frames in three different transitions. Graph 200 shows a transition from G0 to G210 at a first frame 205 and to G159 at a second frame 206 and subsequent frames. Graph 202 shows a transition from G0 to G220 at a first frame 208 and subsequent frames. Graph 204 shows a transition from G0 to G220 at a first frame 212 and to G159 at a second frame 214 and subsequent frames.

As described above, a luminance value associated with the second frame 206 may be determined by accessing the first set of overdrive look-up tables 110. As also described above, the second set of overdrive look-up tables 114 may be determined based on the current frame data 100, previous frame data 104, and the first set of overdrive look-up tables 110. Based on information in the second set of overdrive look-up tables 114, the overdrive value o may be determined. For instance, in the present example in which l is G0, p is G210, and h is G159, o is G220. More specifically, a luminance associated with the second frame 206 in a transition from G0 to G210 to G159 may be determined to be equal to a luminance associated with the first frame 208 in a transition from G0 to G220 by utilizing the second set of overdrive look-up tables 114.

With o having been determined, implementation of the overdrive 30 may cause a transition of pixels of the display 18 from a pre-transition frame (e.g., a previous frame) to a first frame (e.g., overdriven current frame 120) that results in content that is brighter the content would be without implementation of the overdrive. In the present example, implementation of the overdrive, as shown by the graph 204, results in 212 first frame that is overdrive to G220 (i.e., o), and the second frame 214 and subsequent frames are commanded to display at G159. As can be seen from comparing graph 210 to graph 182, implementation of the overdrive 30 causes the first frame 212 to have a higher luminance than in the first frame 186 in which the overdrive 30 is not utilized.

As has been discussed above, the overdrive 30 may cause the first frame in a transition to be commanded to have settings that differ from the final settings associated with the transition. More specifically, the overdrive 30 may cause a frame with overdrive value o to be displayed. For instance, in the example discussed with regard to FIGS. 14-17, the overdrive 30 causes the first frame in a transition from G0 to G159 to have a gray level of G220. However, it should be noted that the overdrive 30 may cause the display 18 to have a first frame with displayed with the values of preliminary overdrive value p. For instance, in the previous example, the value of p is G210. Whether or not the overdrive 30 results in pixels of the display 18 to have preliminary overdrive value p or overdrive value o may be based on the brightness of the display 18. For example, at brightness settings that result in a luminance of the display 18 that is 5 nits or less, implementation of the overdrive 30 may result in pixels of the display 18 to be overdriven to value o at the first frame, while at brightness settings that result in a luminance of the display 18 that is greater than 5 nits, implementation of the overdrive 39 may result in pixels of the display 18 to be overdriven to value p at the first frame.

Moreover, while the previous examples discuss a single frame that is modified as a result of implementation of the overdrive 30, in other embodiments, multiple frames may be modified via implementation of the overdrive 30. As described below, a multiple frame overdrive is achieved by generating and utilizing an additional set of overdrive look-up tables.

Figure 18:
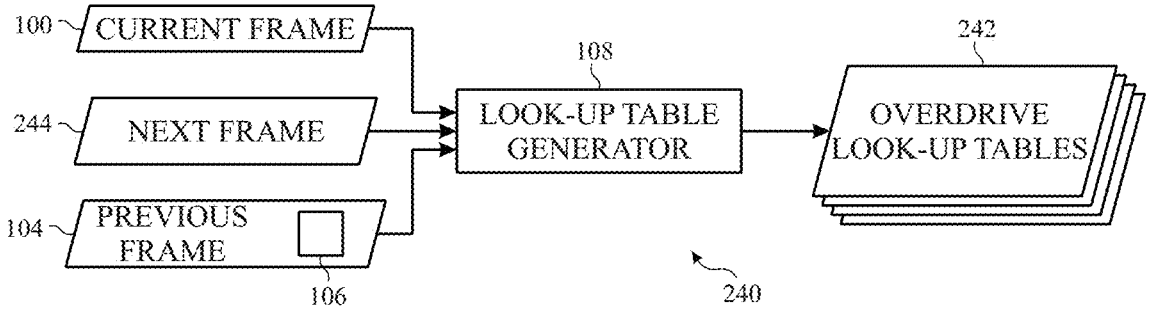
FIG. 18 is a data flow chart of a process for generating a third set of overdrive look-up tables, in accordance with an embodiment.

FIG. 18 is a data flow chart of a process 240 for generating a third set of overdrive look-up tables 242. During the process 240, the current frame data 100, previous frame data 104, and next frame data 244 may be sent to the look-up table generator 108. The next frame data 244 is data associated with the frame that occurs directly after the current frame, and the next frame data 244 may include information that is of the same nature as the previous frame data 104 and current frame data 100. The look-up table generator 108 may generate the third set of overdrive look-up tables 242 based on the current frame data 100, previous frame data 104, and the first set of overdrive look-up tables 110. Similar to the first set of overdrive look-up tables 110 and the second set of overdrive look-up tables 114, the third set of overdrive look-up tables 242 includes information regarding display settings such as RGB color settings, brightness settings, and temperature values. For example, the third set of overdrive look-up tables 242 may include an equivalent value e, which is described below in more detail. Additionally, and as described in more detail with regard to FIG. 20 and FIG. 21, the third set of overdrive look-up tables 242 may also be generated based on information provided in the first set of overdrive look-up tables 110 and the second set of overdrive look-up tables 114.

Figure 19:
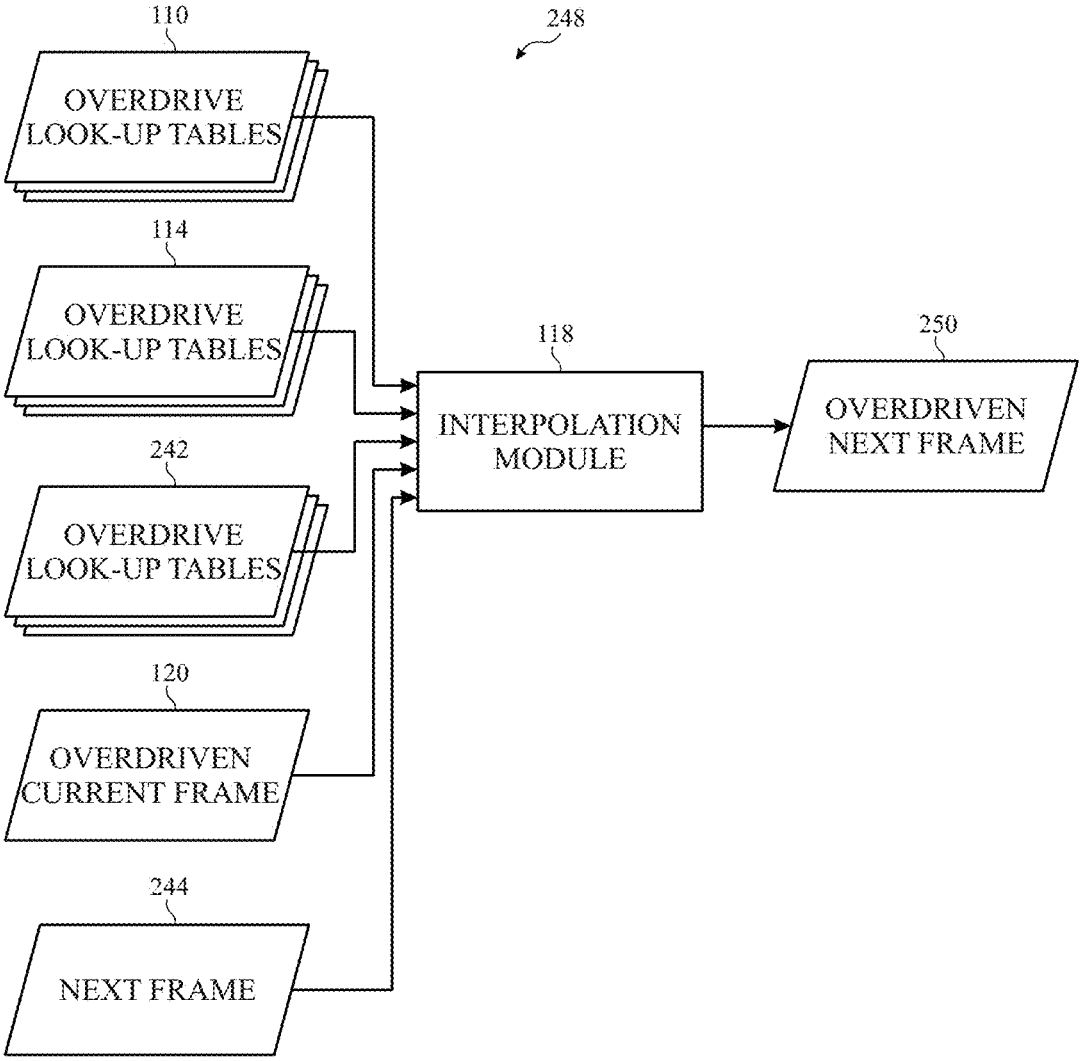
FIG. 19 is a data flow chart of a process for generating an overdriven next frame, in accordance with an embodiment.

FIG. 19 is a data flow chart of a process 248 for generating an overdriven next frame. The overdriven next frame refers to a frame after the current frame that has been modified via implementation of the overdrive 30. In other words, the overdriven next frame includes overdriven next frame data 250 that may include information similar the next frame data 244 that has been modified due to execution of the overdrive 30. For example, the overdriven next frame data 150 may include RGB color settings and luminance settings that differ from RGB color settings and luminance settings of the next frame data 244 due to execution of the overdrive 30.

Figure 20:
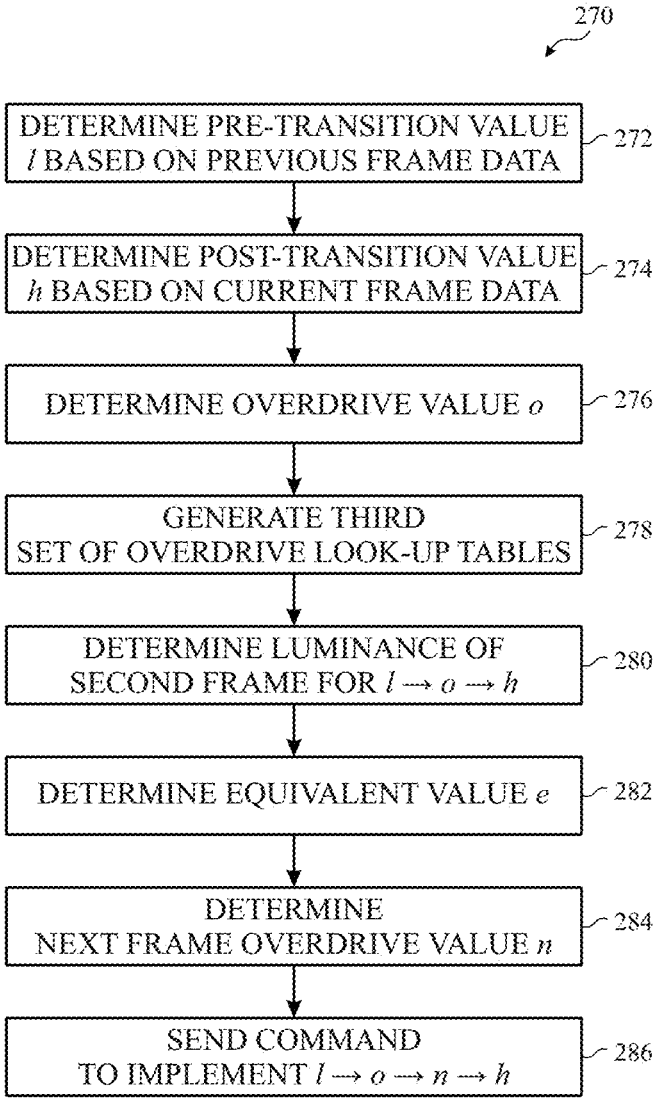
FIG. 20 is a flow chart of a method for implementing an overdrive on multiple frames, in accordance with an embodiment.

FIG. 20 is a flow chart of a method 270 for implementing the overdrive 30 on multiple frames. The method 270 may be performed by the one of more processors 12. Furthermore, while the method 270 describes steps in a certain order, it should be noted that the method 270 may be performed in an order that differs from the order described below. Additionally, as described below, execution of the method 270 includes several steps that are carried out to implement the overdrive 30 on single frame.

For instance, at block 272, the pre-transition value l may be determined based on the previous frame data 104. The value of l may be defined by the previous frame data 104. For example, in a transition from a gray level of 0 (i.e., G0) to a gray level of 127 (i.e., G127), the value of l may be defined as G0 in the previous frame data 104.

At block 174, the post-transition value h may be determined. The value of h may be determined based on information stored in the current frame data 100. Continuing with the example of a transition from G0 to G127, the value of h may be defined as G127.

At block 276, the overdrive value o may be determined as described above with relation to FIG. 13. Determination of the overdrive value o may include generating and utilizing the first and second sets of overdrive look-up tables 110, 114 as well as the preliminary overdrive value p. Continuing with the example of a transition from G0 to G127, the value of o may be defined as G145. As additionally described above, the overdriven current frame data 120 may be used to cause one or more pixels of the display 18 to be commanded to have display settings that include the overdrive value o. For instance, instead of directly transitioning from G0 to G127, the transition may be G0 to G145 to G127.

At block 278, the third set of overdrive look-up tables 242 may be generated. As described above, the third set of overdrive look-up tables 242 may be generated based on the current frame data 100, next frame data 244, previous frame data 104, and first and second sets of overdrive look-up tables 110, 114. To continue with the example of a transition from G0 to G127, the next frame data 244 may include information about the frame after the current frame (i.e., two frames after the pre-transition frame). For instance, in this particular example, the next frame data 244 may include the post-transition value l. That is, the previous frame data 104 is associated with a frame to be displayed at G0, while the current frame data 100 and next frame data 244 may both be associated with frames that are to be displayed at G127.

The third set of overdrive look-up tables 242 may include information regarding potential values of equivalent value e. The equivalent value e refers to a gray level for a first frame in a transition from e to h, where e is greater than l. The value of e is determined based on a luminance associated with the second frame in a transition from l to o to h. In other words, the third set of overdrive look-up tables may include luminance values associated a frame having value h in a transition from one frame to another frame having value h. Continuing with the example of a transition from G0 to G127, the transition from l to o to h would be G0 to G145 to G127, where G0 is associated with a pre-transition frame, G145 is associated with the overdriven current frame, and G127 is associated with the next frame. In this case, the next frame is the second frame. Accordingly, the value of e may be determined based on a luminance associated with the frame in which a portion of the display 18 is commanded to have a value of G127, and the value of e may be determined by utilized the third set of overdrive look-up tables 242.

At block 280, a luminance associated with the second frame in a transition from l to o to h may be determined. In other words, the luminance associated with the second frame in a transition from a pre-transition frame to an overdriven frame to the second frame may be determined.

At block 282, the value of e may be determined based on the luminance associated with the second frame in the transition from l to o to h. In particular, the value of e may be determined by utilizing the third set of overdrive look-up tables 242 to finding a luminance value approximately equivalent to the luminance value determined at block 280 that is associated with a frame having value h in a transition from e to h. Continuing with the example of a transition from G0 to G127, a luminance value associated with a frame having value h in a transition from l to o to h may be determined at block 280. The luminance value may be used to find a value of e that is stored in the third set of overdrive look-up tables 242, where a frame having value h in a transition from e to h has a luminance value approximately equal to the luminance value determined at block 280. In this particular example, the value of e may be G30.

At block 284, a next frame overdrive value n may be determined. The next frame overdrive value n is a value that is stored in the overdriven next frame data 250 such that when the data is utilized, the frame directly after the overdriven current frame is also overdriven. The value of n may be determined by substituting l with e and finding an overdrive value for a transition from e to h. In other words, whereas the overdrive value o is determined based on a transition from l to h, the next frame overdrive value n may be determined in the same way as o for a transition from e to h. Continuing with the example of a transition from G0 to G127 with e being G30, the next frame overdrive value n would be determined for a transition from G30 to G127. Such a determination may be made based on the information stored in the first, second, and third sets of overdrive look-up tables 110, 114, 242. For instance, a preliminary overdrive value may be determined similarly to how p is determined, and the value n may be determined based on the determination of the preliminary overdrive value.

At block 286, a command to implement the overdriven current frame and overdriven next frame may be sent. In other words, a transition from l to o to n to h may be implemented. For example, the one or more processors 12 may send a command that causes pixels of the display 18 to switch from having display settings with value l to value o in the transition from a pre-transition frame to a first frame, from value o to value n in a transition from the first frame to a second frame, and from value n to value h in a transition from the second frame to the third frame. It should also be noted that in some cases in which a preliminary overdrive value associated with n is determined, such a preliminary overdrive value may be used instead of n.

Figure 21:
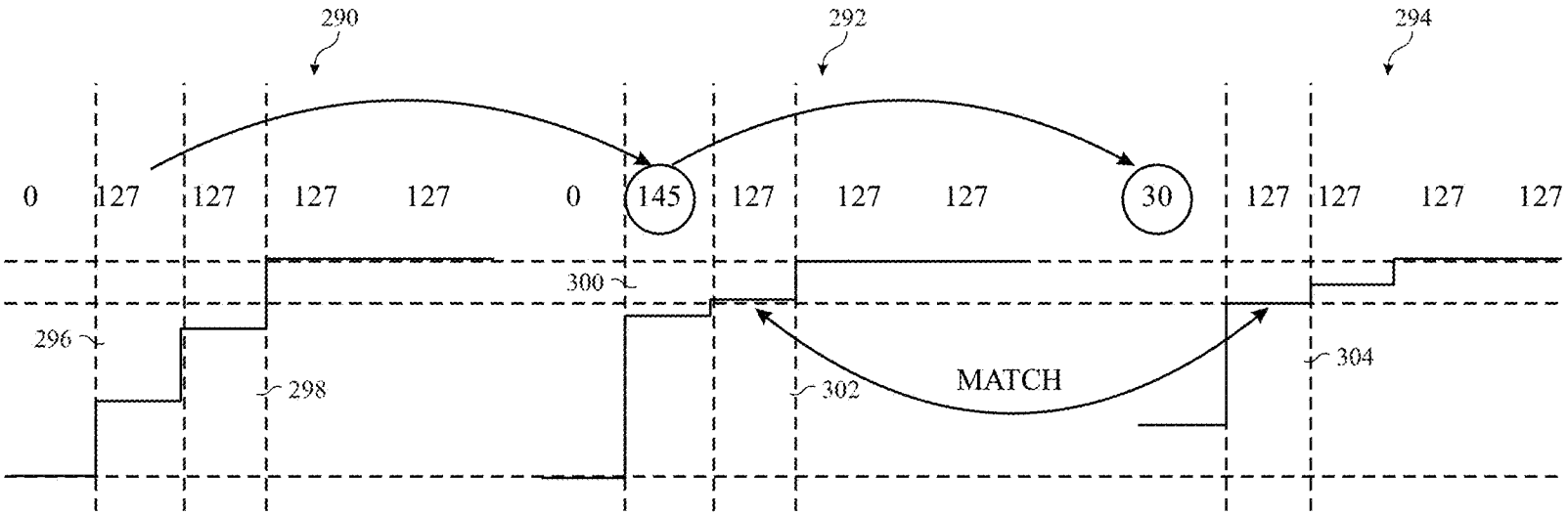
FIG. 21 illustrates graphs showing relative luminance levels associated with frames in three different transitions, in accordance with an embodiment.

FIG. 21 is provided to illustrate how e may be determined. More specifically, FIG. 21 includes graphs 290, 292, 294. Each of the graphs 290, 292, 294 shows luminance values with respect to gray values of frames in various transitions. Graph 290 shows a transition from G0 to G127. Graph 292 shows a transition from G0 to G145 to G127, and graph 294 shows a transition from G30 to G127.

As described above in the example described in relation to FIG. 20, graph 290 shows a transition that does not include any overdriven frames. For instance, starting from G0, a first frame 296 and a second frame 298 are commanded to be displayed at a value of G127. However, an overdrive value o may be determined for the transition from G0 to G127 and used to overdrive the first frame 296. Indeed, graph 292 shows the same transition as graph 290 except that a first frame 300 is overdriven to be displayed at a value of G145. A second frame 302 (and subsequent frames) are to be displayed at G127.

As described above, the value of e may be determined based on a luminance associated with the second frame 302. The graph 294 includes a first frame 304 that has a luminance value approximately equivalent to the luminance value associated with the second frame 302. In others, a transition from G30, which is e in this case, to G127 results in a luminance similar to the luminance associated with the last frame in a transition from G0 to G145 to G127. As described above, the equivalent value e may be used in the determination of the next frame overdrive value n, which may be utilized to cause multiple frames to be overdriven.

While the overdrive 30 is described as software that is executed via the one or more processors 12, in other embodiments, the overdrive 30 may be implemented via hardware. For example, in other embodiments, the overdrive 30 may be implemented via a system on a chip.

Additionally, the overdrive 30 may be used to "underdrive" frames of content. For example, in a transition from a frame with pre-transition settings associated with a first luminance to a second frame with post-transition settings associated with a second luminance that is less than the first luminance, the overdrive 30 may be employed to determine an underdrive value associated with the second frame. In such an example, the second frame may be displayed using the underdrive value. That is, in such an example, the second frame may be displayed using a compensated value such that the output of the display 18 during the second frame more closely resembles a subsequent frame associated with the second luminance.

Figure 22:
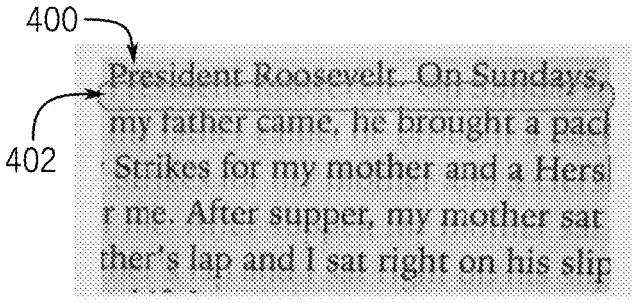
FIG. 22 illustrates high-contrast content aberrations displayed on the display of the electronic device of FIG. 1, in accordance with an embodiment.

As discussed below, visual artifacts may occur during operation of the electronic device 10. More specifically, users of the electronic device 10 may perceive visual artifacts on the display 18 of the electronic device for various reasons, including high-speed movement of high contrast content. For instance, visual artifacts may appear in the form of shadows on the display 18. For example, FIG. 22 illustrates content on the display 18 where, as a user causes text 400 of the content to move within the display 18 (e.g., scrolling up or down), the text 400 may appear to have shadows 402. The shadows 402 may appear due to the pixels of the display 18 providing light having darker characteristics than the light intended to be displayed 18. For example, in some cases, the pixels of the display may not transition quickly enough between providing light associated with relatively low gray levels (e.g., darker content such as the text 400) to providing light associated with higher gray levels (e.g., relatively lighter content such as a white background). In general, the higher the luminance of the display 18, the more perceptible the shadows 402 may be to the human eye.

Figure 23:
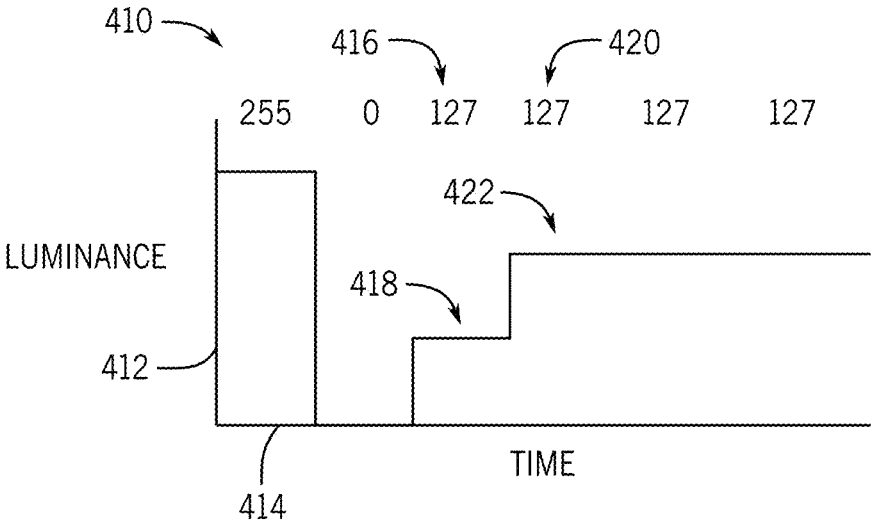
FIG. 23 illustrates a graph of typical luminance over time for adjusted high-contrast content, in accordance with an embodiment.

The shadow effect illustrated in FIG. 22 may be caused from a transition from a high gray level to a low gray level to a gray level higher than the low gray level. For example, FIG. 23 illustrates a graph 410 showing typical luminance (e.g., indicated by axis 412) over time (e.g., as indicated by axis 414) for adjusted high-contrast content. More specifically, the graph 410 illustrates luminance levels of the display 18 during a transition from G255 to G0 to G127. As illustrated, and as generally discussed above (e.g., with regard to FIG. 15, more than one frame of content may be displayed via the display 18 during the transition from one gray level (e.g., G0) to a second gray level (e.g., G127) before a luminance associated with the second gray level. Indeed, as illustrated in FIG. 23, when a first frame 416 is displayed, a first luminance 418 below a target luminance is displayed before the target luminance is achieved. However, when a second frame 420 is displayed, a second luminance 422 (e.g., the target luminance) that is greater than the first luminance 418 is obtained.

Figure 24:
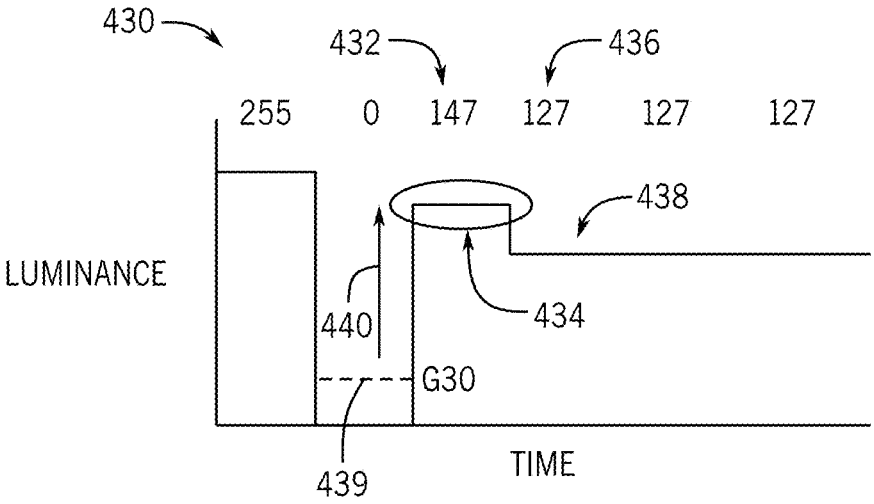
FIG. 24 illustrates a graph of a transition from G255 to G0 to G127 in which an overdrive is implemented, in accordance with an embodiment.

As described above, to minimize display aberrations caused by the transition time between these gray levels, an overdrive (e.g., overdrive 30) may be implemented to provide a luminance at a first frame in a transition that is more similar to a target luminance. Implementing the overdrive 30 may reduce the occurrence of visual artifacts (e.g., shadows 402). For example, FIG. 24 illustrates a graph 430 of a transition from G255 to G0 to G127 in which the overdrive 30 is implemented. In particular, in transitioning from G0 to G127, a first frame 432 may be associated with an elevated gray level (e.g., G147), which results in a first luminance 434. At subsequent frames, such as a second frame 436, a second luminance 438, which may be the luminance associated with an actual target luminance, is obtained. However, because there was a transition from a relatively high gray level (e.g., G255) to a relatively low gray level (e.g., G0) prior to the transition from G0 to G127, the first luminance 434 may be higher than the target luminance associated the target gray level (e.g., G127). In some embodiments, this may occur because the transition from G255 to G0 may not result in the frame data actually reaching G0, but instead, an intermediate luminance level, such as luminance level 439 (e.g., G30), causing transition to the overdrive luminance value to be achieved more rapidly (because the overdrive value is calculated based upon a transition from G0 to G127, which needs a higher overdrive value than the actual transition of G30 to G127). In other words, as illustrated in the graph 430, applying the overdrive 30 may overcompensate 440, resulting in a luminance (e.g., first luminance 434) that is greater than a target luminance value.

Figure 25:
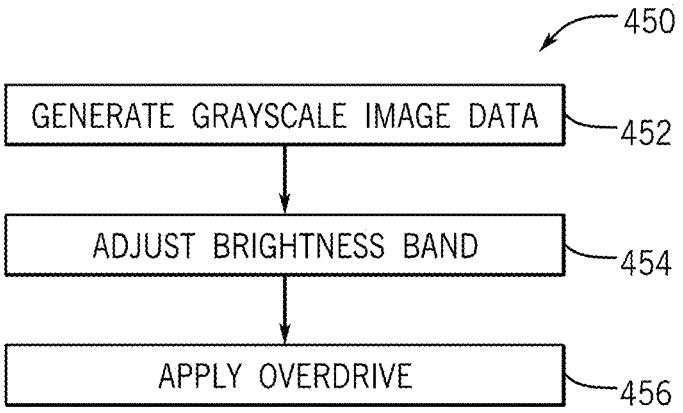
FIG. 25 is a flowchart of a process for applying an overdrive, in accordance with an embodiment.

Additionally, for transitions to a relatively high gray level (e.g., a transition to G255), it may not be possible to apply the overdrive 30. For instance, because there is no gray level higher than 255, it may not be possible to apply the overdrive 30 to produce a first frame with a higher luminance. Keeping the discussion of FIGS. 22-24 in mind, FIG. 25 is a flowchart of a process 450 for applying the overdrive 30. More particularly, the process 450 may be performed by the one of more processors 12 to cause the overdrive 30 to be applied in transitions involving relatively high gray levels, such as G255.

At process block 452, grayscale image data may be generated. For instance, gray levels associated with image data received by the one or more processors 12 may be determined. As noted above, grayscale values may be determined for each pixel as a whole (i.e., as a combination of RGB color settings), or for each color component of a pixel (e.g., one grayscale value for a red value, one grayscale value of the green value, and one grayscale value for a blue value).

Figure 26:
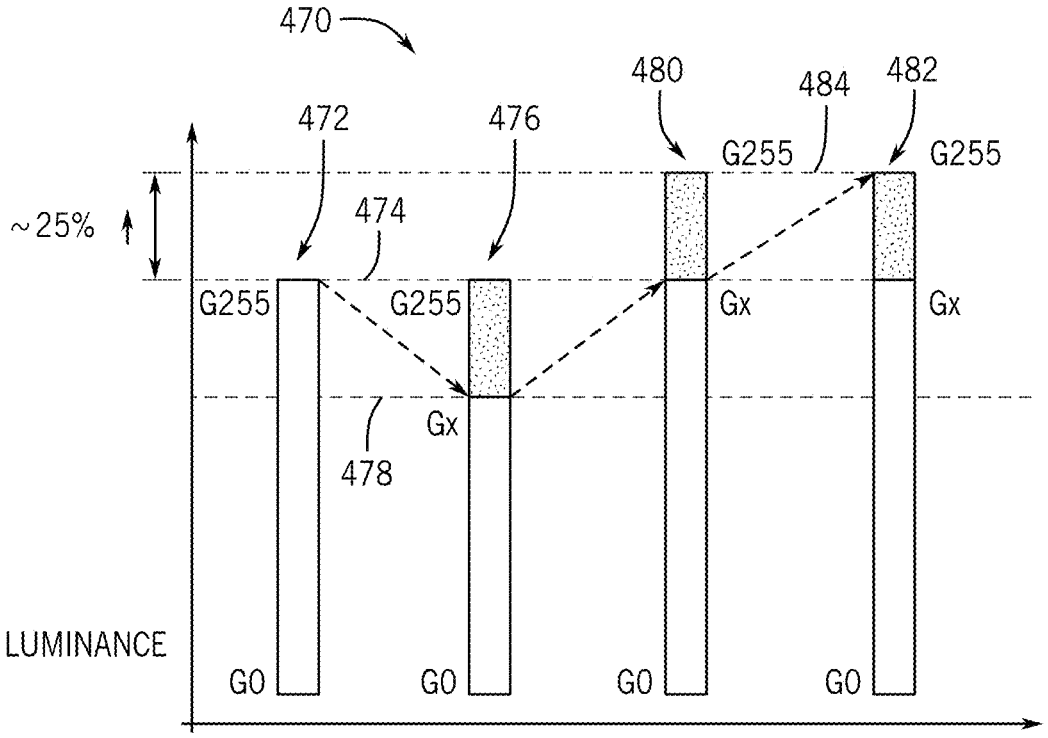
FIG. 26 is a graph illustrating brightness band adjustment, in accordance with an embodiment.

At process block 454, a brightness band associated with the grayscale image data may be adjusted. To help illustrate, FIG. 26 is a graph 470 illustrating brightness band adjustment. A first frame of content 472 may be associated with a first gray level (e.g., G255) and a first luminance (e.g., as indicated by line 474). A second frame 476 of content may be associated with a second gray level (e.g., GX, where X is less than 255) and a second luminance (e.g., as indicated by line 478) that is less than the first luminance. A third frame 480 and fourth frame 482 are associated with a brightness band adjustment. As illustrated, a maximum luminance (e.g., as indicated by line 484) may be utilizable by the electronic device 10. In particular, to achieve the brightness band adjustment, the pixel settings associated with the display 18 may be modified. For example, the line 474 may be associated with an original maximum luminance that may occur by displaying content on the display 18. However, the original maximum luminance may be not be that absolute maximum luminance that the display 18 may be configured to achieve. Accordingly, a brightness band adjustment may be performed to enable the display 18 to utilize a higher luminance. In the illustrated embodiment, the brightness band adjustment results in an absolute maximum luminance (e.g., as indicated by line 484) that is approximately 25% greater than the luminance associated with the line 474. By enabling the display 18 to have a higher luminance, the overdrive 30 may be applied to frames of content with relatively high gray values (e.g., G220-G255).

Figure 27:
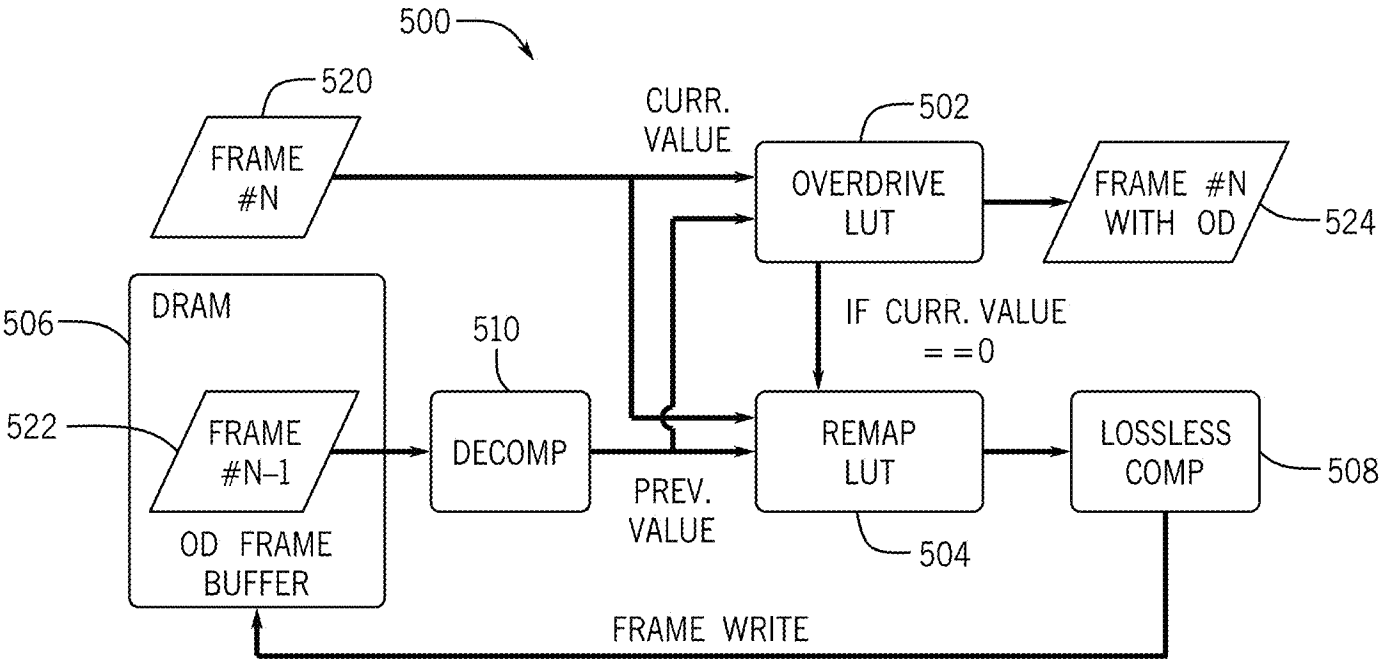
FIG. 27 is a schematic diagram of an overdrive system that may implement an overdrive, in accordance with an embodiment.

Referring back to FIG. 25, at process block 256, the overdrive 30 may be applied. However, as discussed below, in some embodiments, the overdrive 30 may be applied somewhat differently than as described above. This may be especially true for high contrast, fast-paced content. FIG. 27 illustrates an overdrive system 500 that may be utilized to implement the overdrive 30 with modification based upon fast-paced and high contrast content. For instance, as mentioned above, while the overdrive 30 may be implemented by executing software instructions, the overdrive 30 may also be implemented via hardware, such as a system on a chip. The overdrive system 500 includes an overdrive look-up table 502, a remap look-up table 504, memory 506, a data compression module 508, and a data decompression module 510.

The various components of the overdrive system 500 may send and receive data. For example, the overdrive look-up table 502 and remap look-up table 504 may receive current frame data 520 and previous frame data 522. The current frame data 520 is data associated with a current frame that is to be displayed, whereas the previous frame data 522 relates to the last frame displayed. For instance, continuing the example of a transition from G255 to G0 to G127, the current frame data 520 may include data indicative of a gray level of zero after the G255 frame is displayed. In other words, the current frame data 520 may be associated with G0. In this example, the previous frame data 522 would be associated with G255.

The remap look-up table 504 serves to prevent the occurrence of overcompensation (e.g., as shown in graph 430 of FIG. 24) that may occur due to implementation of the overdrive 30 after a high contrast change in pixels. More specifically, the remap look-up table 504 may modify gray levels associated with image data to reduce overcompensation. Generally speaking, the gray level indicated by the current frame data 520 will become the gray level indicated by the previous frame data 522 when a next frame of image data is to be presented. However, as mentioned above with regard to the discussion of FIG. 24, this can sometimes be problematic when there is a large change in gray level for a pixel (e.g., a high contrast change (e.g., from G255 to G0, etc.)). Accordingly, when such a high contrast change is detected by the remap look-up table 504 (e.g., by comparing the current frame data 520 and the previous frame data 522), the remap look-up table 504 may modify the overdrive data to represent a transition from a gray level different than the gray level indicated by the current frame data 520. In particular, in some embodiments, when the previous frame data 522 that is stored in the memory 506 is indicative of a relatively high gray level (e.g., G220-G255) and the current frame data is indicative of a relatively low gray level (e.g., G0-G30), the remap look-up table 504 may generate new previous frame data 522 that is indicative of a gray level that is higher than the gray level indicated by the current frame data 520. The gray level determined by the remap look-up table 504 may be referred to as an "overdrive over-compensation mitigation gray level."

Continuing with the example of the transition from G255 to G0 to G127, at a first time, the current frame data 520 may be indicative of G0, and the previous frame data 522 may be indicative of the G255. The remap look-up table 504 may receive these gray levels and determine new previous frame data 522 that will be compressed by the data compression module 508 and stored in the memory 506, which may be included in the memory 14. For example, for current frame data 520 indicative of a gray level of G255 and previous frame data indicative of G0, the remap look-up table 504 may generative new previous frame data indicative of a gray level of G30. In some embodiments, this gray level may be an estimate of the luminance level 439 of FIG. 24 (e.g., where the pixel transitioned to during the high contrast pixel change). By adjusting this previous frame data 522, compensation for a lack of actual transition to G0 (or other low gray level) may occur.

At a later time, such as when the next frame of image data is prepared to be displayed, the current frame data 520 may be indicative of G127, and the previous frame data 522 stored in the memory 506 may be indicative of G30. The previous frame data 522 may be decompressed via the data decompression module 510, and the overdrive look-up table 502 may receive the current frame data 520 and the previous frame data 522. The overdrive look-up table 502 may generate the overdriven current frame data 524 based on the current frame data 520 and the modified previous frame data 522. Because the transition (e.g., G30 to G127) is associated with a remapped gray value, the overdrive look-up table 502 may generate overdriven current frame data 524 that is indicative of a gray level that is lower than a gray value that would be obtained for a transition from G0 to G127. Accordingly, by utilizing the remap look-up table 504, a gray value that does not cause overcompensation may be obtained.

Figure 28:
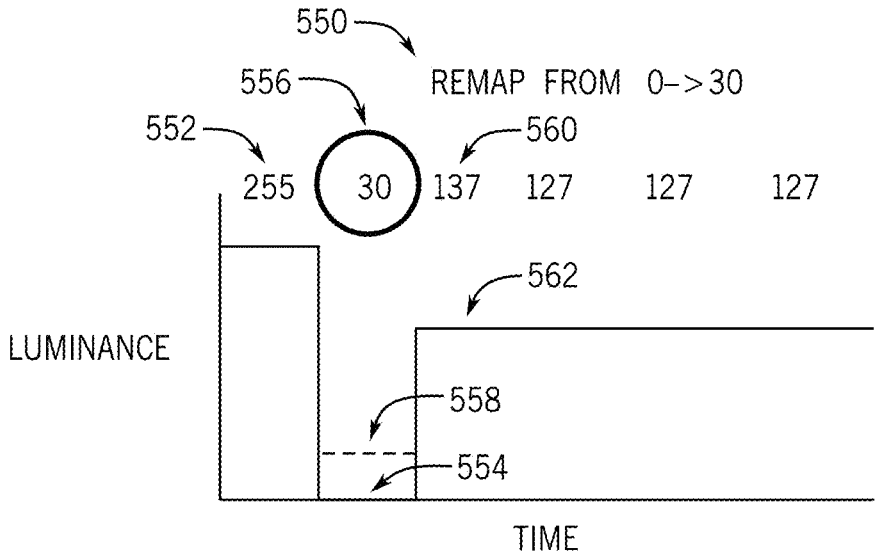
FIG. 28 is a graph illustrating a transition from G255 to G0 to G127 in which remapping takes place, in accordance with an embodiment.

For example, FIG. 28 is a graph 550 illustrating a transition from G255 to G0 to G127 in which remapping takes place. As shown, a gray level of G255 is associated with a first frame 552. As indicated by the luminance 554 displayed, a gray value of G0 was associated with a second frame 556. Based on gray values of G255 and G0, the remap look-up table 504 provided previous frame data 522 indicative of G30. In other words, while the luminance 554 associated with G0 is displayed, the previous frame data 522 stored in the memory 506 may reflect a different gray value (e.g., G30) that is associated with a different luminance 558. Determining the different gray value, which may also be referred to as remapping, enables a gray value that does not cause overcompensation to be obtained. For instance, while the transition from G0 to G127 is treated as a transition from G30 to G127, which results in a third frame 560 having a luminance 562. As can be seen from comparing the luminance 562 to the luminance 434 of graph 430, performing remapping provides a luminance (e.g., luminance 562) with less, if any, overcompensation.

Figure 29:
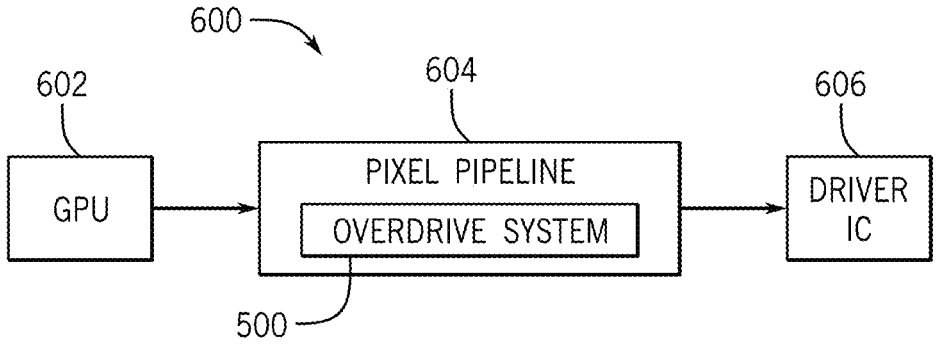
FIG. 29 is a schematic diagram of an image processing system, in accordance with an embodiment.

Utilization of the overdrive 30 may cause the electronic device 10 to consume more power than would be consumed if no overdrive were implemented. Bearing this in mind, FIG. 29 is a schematic diagram of an image processing system 600 that includes a graphics processing unit (GPU) 602, a pixel pipeline 604, and a driver integrated circuit 606. The graphics processing unit 602 and driver integrated circuit 606 may be included in the one or more processors 12 of the electronic device. The pixel pipeline 604, which may include the overdrive system 500 may be implemented using hardware (e.g., processing circuitry of the one or more processors 12), software (e.g., stored in the memory 14 or nonvolatile storage 16), or a combination of hardware and software.

The graphics processing unit 602, pixel pipeline 604, and driver integrated circuit 606 perform tasks related to the processing and displaying of image data. For example, the graphics processing unit 602 may receive image data (e.g., from the memory 14 and/or the nonvolatile storage 16) and process the image data 60. In particular, the image data may include various images, or frames, of content that the graphics processing unit 602 may render at a frame rate, which is referred to herein as a "GPU rendering frame rate." The GPU rendering frame rate may be defined in hertz, and the GPU rendering rate may vary. In other words the GPU rendering rate may change from time to time (e.g., based on a user interaction with the electronic device 10).

The pixel pipeline 604 may receive image data from the graphics processing unit 602 and further process the image data at a rate that is referred to herein as a "pixel pipeline frame rate." For example, the pixel pipeline 604 may determine settings associated with pixels of the display 18 of the electronic device 12. For instance, as noted above, the pixel pipeline 604 may include the overdrive system 500. Accordingly, the pixel pipeline 604 may implement the overdrive 30 discussed above. It should also be noted that, in general, the pixel pipeline frame rate may be equal to the GPU rendering frame rate. In other words, the pixel pipeline 604 may process image data (e.g., frames of content) at the same rate as the graphics processing unit 602. However, as discussed above, in some cases, the GPU rendering frame rate and the pixel pipeline frame rate may differ.

The driver integrated circuit 606 may receive processed image data from the pixel pipeline 604 and cause the pixels of the display 18 to emit light in accordance with the processed image data. The driver integrated circuit 606 may cause the pixels of the display 18 to display image data at a refresh rate associated with the display 18. For example, if the display were to operate with a refresh rate of 60 hertz, the driver integrated circuit 606 may update image data (e.g., pixel data) that will be displayed by the pixels of the display 18 at a rate of 60 hertz.

In general, the higher the GPU rendering rate and the higher the pixel pipeline frame rate, the higher the amount of power the electronic device 10 consumes. More specifically, because more calculations are performed (e.g., more frames of content processed per second), the electronic device 10 may utilize energy from the power source 29 at a higher rate compared to when relatively lower GPU rendering rates and pixel pipeline frame rates.

Figure 30:
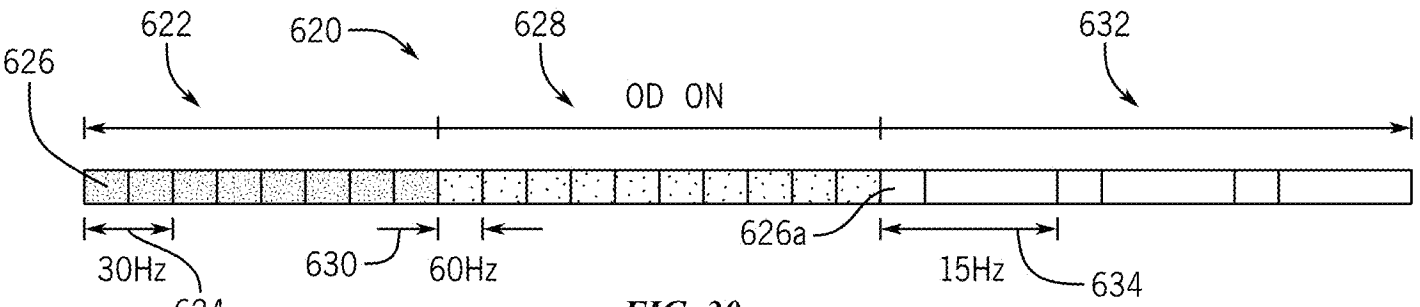
FIG. 30 is a chart illustrating image data where overdrive is applied, in accordance with an embodiment.

Keeping the discussion of FIG. 29 in mind, FIG. 30 illustrates a chart 620 of image data. In particular, the chart 620 illustrates GPU rendering frame rates and pixel pipeline frame rates when the overdrive 30 is implemented. For example, the chart 620 includes a first region 622 in which a first GPU rendering frame rate 624 of 30 hertz is implemented. Additionally, each block 626 represents a pixel pipeline frame. In the first region, there are two blocks 626 for each frame processed by the graphics processing unit 602. In other words, while the first GPU rendering frame rate 624 is 30 hertz, while the overdrive 30 is implemented, the pixel pipeline frame rate is equal to 60 hertz. In effect, the pixel pipeline 604 may generate two sets of pixel data for each frame of content processed by the graphics processing unit 602. In other words, there is a twofold increase in the number of frames of content generated by the pixel pipeline 604 compared to the number of frames generated by the graphics processing unit 602.

Continuing with the discussion of the chart 620, the chart 620 includes a second region 628 associated with a second GPU rendering frame rate 630 of 60 hertz. As illustrated, the blocks 626 of the second region 628 have the same width as the line representing the second GPU rendering frame rate 630, signifying that the pixel pipeline frame rate associated with the second region 628 is also 60 hertz. That is, while the GPU rendering frame rate is 60 hertz, the pixel pipeline frame rate is 60 hertz. Accordingly, unlike the first region 622 (i.e., when the electronic device 10 is operating with a GPU rendering frame rate of 30 hertz), when the GPU rendering frame rate is 60 hertz, there may be no increase in the number of frames of content generated by the pixel pipeline 604 compared to the number of frames generated by the graphics processing unit 602.

During times associated with a third region 632 of the chart 620, the graphics processing unit 602 may process image data at a third GPU rendering frame rate 634 of 15 hertz. When utilizing the overdrive 30, and additional frame 626*a* is added that is associated with a pixel pipeline frame rate of 60 hertz. In other embodiments, it should be noted that utilizing the overdrive 30 while the graphics processing unit 602 is operating at the third GPU rendering frame rate 634 may result in refresh rate may result in two frames that are associated with a pixel pipeline frame rate of 30 hertz.

Figure 31:
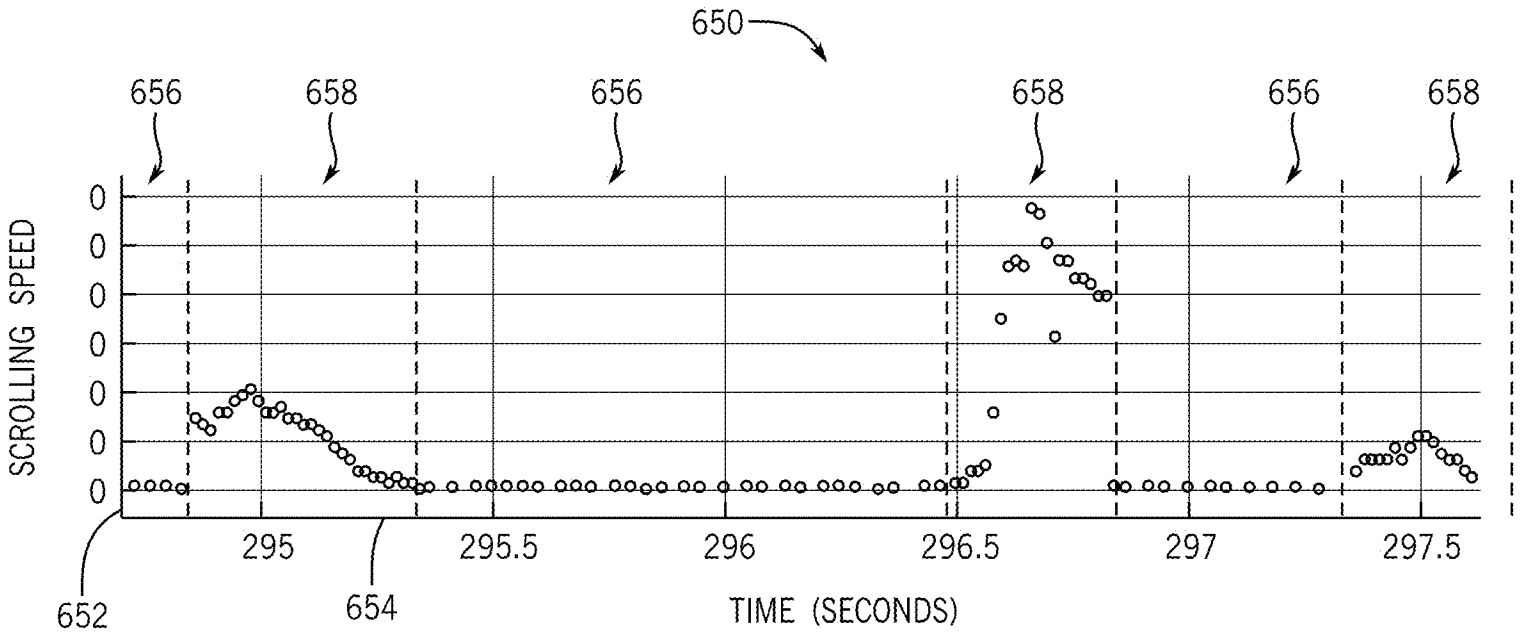
FIG. 31 illustrates a graph of scrolling speed versus time, in accordance with an embodiment.

By selectively implementing the overdrive 30, the electronic device 10 may utilize less power. In one embodiment, the overdrive 30 may be implemented based on a scrolling speed associated with the display 18 of the electronic device 10. With this in mind, FIG. 31 illustrates a graph 650 of scrolling speed (as indicated by a first axis 652) versus time (as indicated by a second axis 654). While the scrolling speed associated with the display is relatively low, such as shown in non-overdrive regions 656), the overdrive 30 may not be implemented. However, when the scrolling speed is relatively high, such as shown in overdrive regions 658, the overdrive 30 may be implemented.

Figure 32:
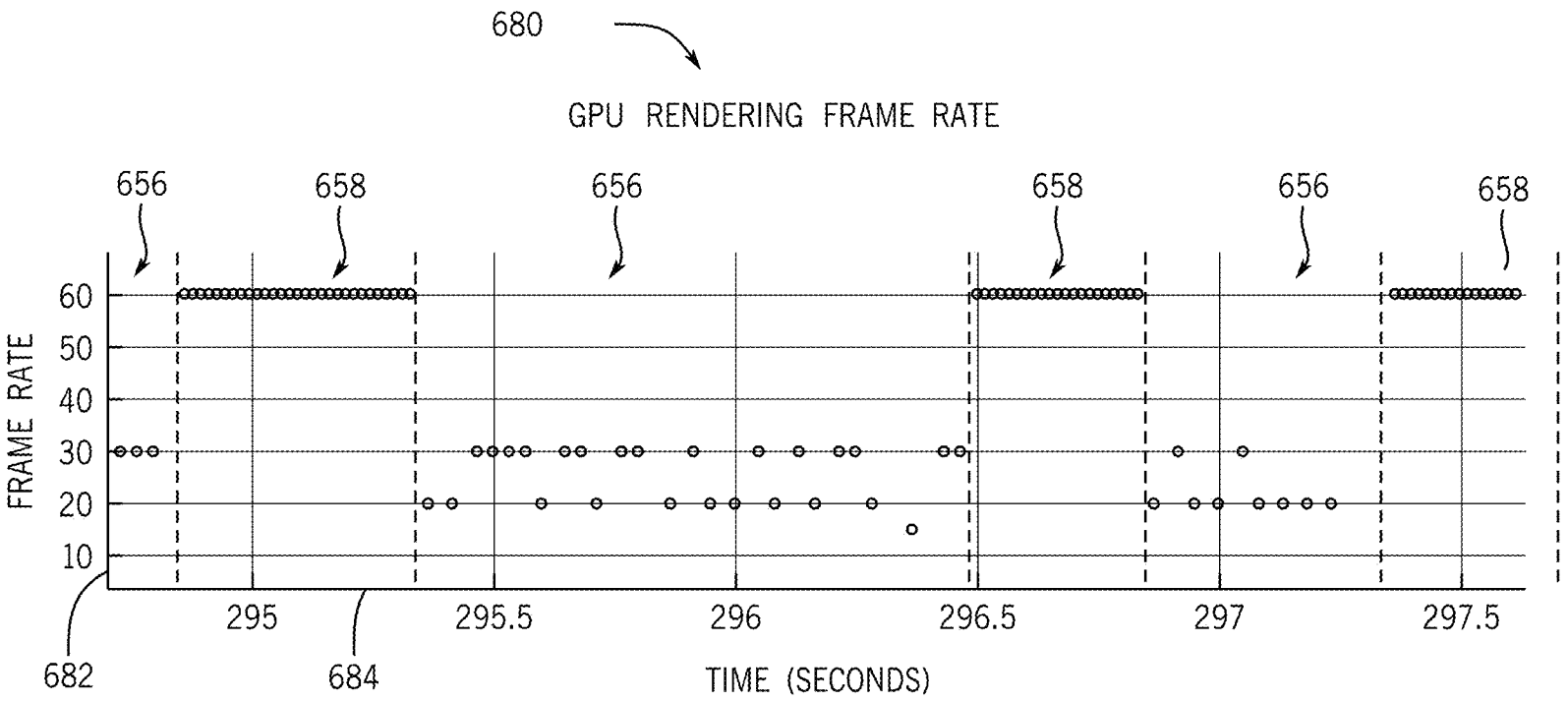
FIG. 32 illustrates a graph of GPU rendering frame rate versus time, in accordance with an embodiment.

The rate at which the graphics processing unit 602 processes image data (i.e., the GPU rendering frame rate) may also be modified based on scrolling speed. For example, FIG. 32 illustrates a graph 680 of the GPU rendering frame rate (e.g., as indicated by a first axis 682) versus time (as indicated by a second axis 684). The data illustrated in the graph 680 corresponds to the data shown in the graph 650 of FIG. 31. The graph 680 illustrates that during times in which the overdrive 30 is not active (e.g., as indicated by non-overdrive regions 656), the GPU rendering frame rate ranges from 15 to 30 hertz. However, when the overdrive 30 is active, as indicated by the overdrive regions 658, the graphics processing unit 602 operates with a GPU rendering frame rate of 60 hertz. By operating the graphics processing unit 602 at GPU rendering frame rate while the overdrive 30 is implemented, less frames of content will be generated by the pixel pipeline 604. In other words, the GPU rendering frame rate and pixel pipeline frame rate may more frequently be equal. Because less frames of content will be generated by the pixel pipeline 604, less power is consumed by the electronic device 10.

Figure 33:
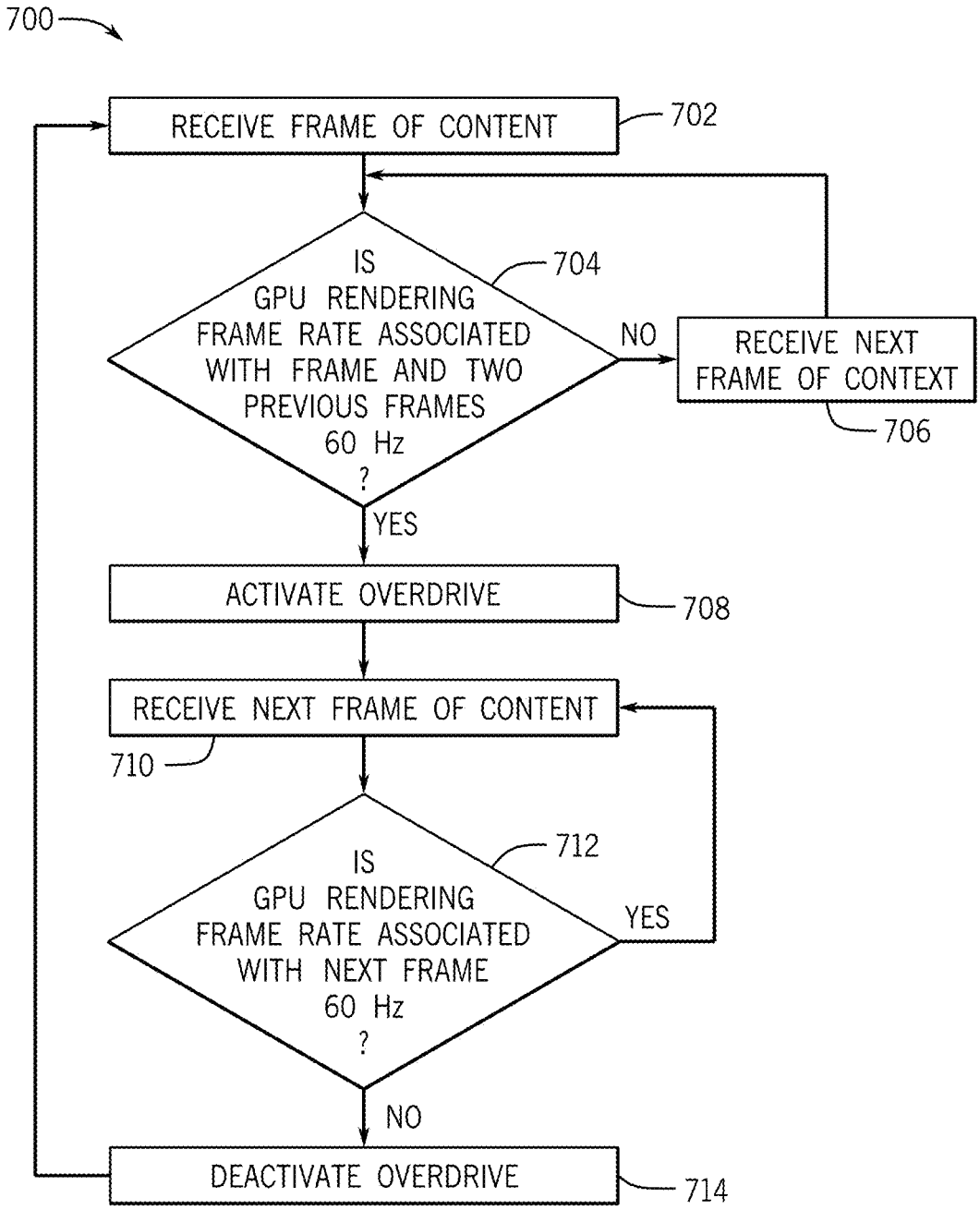
FIG. 33 is a process for controlling implementation of an overdrive based on a GPU rendering frame rate, in accordance with an embodiment.

FIG. 33 is a process 700 for controlling implementation of the overdrive 30 based on GPU rendering frame rate. As discussed above, the GPU rendering frame rate may be determined based on a scrolling speed associated with the display 18. The process 700 may be performed by the one or more processors 12, the overdrive system 500, and/or the image processing system 600 of the electronic device 10.

At process block 702, a frame of content may be received. For example, the frame of content may be received from the graphics processing unit 602. The frame of content may be associated with a GPU rendering frame rate. For example, the frame may correspond to a duration of time associated with a GPU rendering frame rate of 15 hertz, 20 hertz, 30 hertz, 60 hertz, or other rates.

At decision block 704, it is determined whether the GPU rendering frame rate associated with the frame and two frames immediately preceding the frame are associated with a threshold GPU frame processing rate (e.g., 60 hertz). In other words, whether the frame of content received at process block 702 and the two frames of content that immediately preceded the frame of content received at process block 702 are received may each be associated with a GPU rendering frame rate. At decision block 704, it may be determined whether each of these frames is associated with the threshold GPU rendering frame rate (e.g., 60 hertz). If the frame and the two previous frames are not rendered at or above the threshold GPU rendering frame rate, at process block 706, a next frame of content may be received (e.g., from the graphics processing unit 602).

However, if the GPU frame rendering frame rate associated with the frame and the two previous frames are rendered at or above the threshold GPU rendering frame rate, at process block 708, the overdrive 30 may be activated. For example, the overdrive 30 may be applied to frames of content after the frame of content received at process block 702 using the techniques discussed above. As discussed below, the overdrive 30 may remain activated and applied to subsequent frames until it is determined that a subsequent frame is not rendered at or above the threshold GPU rendering frame rate.

For instance, at process block 710, a next frame of content may be received, for example, from the graphics processing unit 602. At decision block 712, it is determined whether the next frame of content is rendered at or above the threshold GPU rendering frame rate. If the next frame of content, the overdrive 30 may be applied to the next frame of content. Additionally, another frame of content may be received (process block 710).

However, if the GPU rendering frame rate associated with the next frame of content is not rendered at or above the threshold GPU rendering frame rate, at process block 714, the overdrive 30 may be deactivated. The process 700 may then repeat as long as additional frames of data are available for retrieval.

Before continuing with the discussion of the drawings, it should be noted that the process 700 is provided as merely one embodiment of controlling implementation of the overdrive 30. In other embodiments, portions of the process 700 may be modified. For example, rather than determining whether a frame of content and the previous two frames of content are rendered at or above a particular threshold GPU rendering frame rate, in other embodiments, the process 700 may include determining whether a different number of frames (e.g., one, two, four, five, six) frames of content are associated with a particular threshold GPU rendering frame rate. The number of frames compared against the threshold GPU rendering frame rate may be adjusted to tradeoff between power savings and responsiveness. For example, the higher the number of frames that are compared against the threshold, the less rapid the overdrive 30 will be activated, but the higher the power savings.

Figure 34:
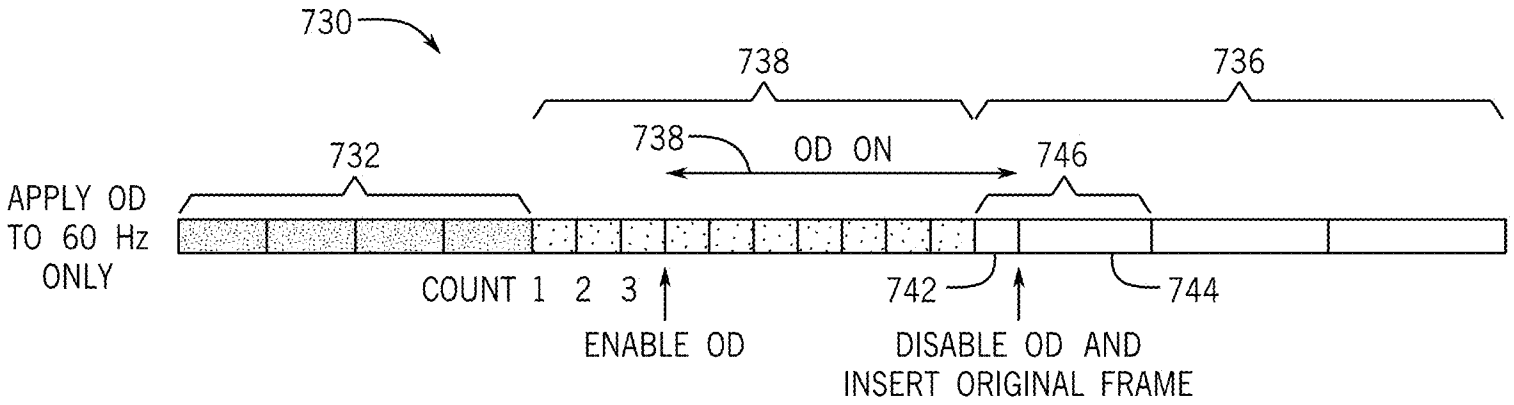
FIG. 34 is a chart of image data where overdrive is applied at a particular frame rate, in accordance with an embodiment.

Turning now to FIG. 34, which illustrates a chart 730 of image data where overdrive is only activated for particular frame data. In general, the chart 730 provides an example of an implementation of the process 700 discussed above with respect to FIG. 33. In particular, the chart 730 illustrates three regions of content that are each associated with different GPU rendering frame rates. For instance, a first region 732 is associated with a GPU rendering frame rate of 30 hertz, a second region 734 is associated with a GPU rendering frame rate of 60 hertz, and a third region 736 is associated with a GPU rendering frame rate of 15 hertz.

FIG. 34 also includes an overdrive region 738. Frames of content (as indicated by blocks within the first region 732, second region 734, and third region 736) that are included in the overdrive region 738 are frames of content to which the overdrive 30 is applied. As illustrated, there three frames of content that are associated with a GPU rendering frame rate of 60 hertz before the overdrive 30 is activated an applied to subsequent frames of content.

As additionally illustrated, one frame 742 of content associated with a GPU rendering frame rate of 15 hertz is in the overdrive region 738. Accordingly, the overdrive 30 is applied to the frame 742. More specifically, the frame 742 may be generated during implementation of the overdrive 30, and the frame 742 may be associated with a GPU rendering frame rate of 60 hertz. Additionally, the frame 744 may also be generated. In other words, the frame 742 may be associated with a portion of image data associated with a frame 746 that is associated with a GPU rendering frame rate of 15 hertz. When the frame 746 is received, the overdrive 30 may be deactivated, during which time the frame 742 may be generated (e.g., in the pixel pipeline 604). For instance, the frame 742 may be inserted into the frame 746. Accordingly, by controlling the overdrive 30 in accordance with the process 700, the pixel pipeline 604 may generally operate without generating additional frames of content.

While the discussion above is directed to implementing the overdrive 30 based on a GPU rendering frame rate associated with the electronic device 10, in other embodiments, the overdrive 30 may be implemented based on characteristics of the electronic device 10. For example, in other embodiments, the overdrive 30 may be implemented based on software being implemented by the one or more processors 12 of the electronic device 12. For instance, while the electronic device 10 is running certain programs or applications, the overdrive 30 may be activated, while for other programs or applications, the overdrive 30 may be inactive.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device, comprising:

a display configured to display content; and one or more processors configured to:

identify a high contrast transition from a first gray level of a first frame of the content to a second gray level of a second frame of the content;

determine an overdrive over-compensation mitigation gray level based upon the high contrast transition;

identify a transition from the second frame of the content to a third frame of the content having a third gray level;

determine whether the first frame and second frame are respectively associated with a first frame rate and a second frame rate that are greater than or equal to a threshold rendering frame rate;

after determining whether the first frame and second frame are respectively associated with the first frame rate and the second frame rate, determine an overdrive gray level based upon the overdrive over-compensation mitigation gray level and the third gray level; and cause the third frame of the content to be displayed at the overdrive gray level.

2. The electronic device of claim 1, wherein the one or more processors are configured to determine the overdrive over-compensation mitigation gray level based on a delta between the first gray level and the second gray level.

3. The electronic device of claim 1, comprising memory, wherein the electronic device is configured to store the overdrive over-compensation mitigation gray level in the memory as a replacement to the second gray level.

4. The electronic device of claim 1, wherein the electronic device is configured to perform a brightness band adjustment such that a first maximum luminance of the display associated with the first frame is increased to a second maximum luminance of the display associated with the third frame.

5. The electronic device of claim 1, wherein the one or more processors are configured to determine the overdrive gray level after determining that the first frame and second frame are respectively associated with the first frame rate and the second frame rate that are greater than or equal to the threshold rendering frame rate.

6. The electronic device of claim 1, comprising a graphics processing unit, wherein the first frame rate and second frame rate are respectively associated with rates at which the graphics processing unit renders the first frame and the second frame.

7. The electronic device of claim 1, wherein the threshold rendering frame rate is sixty hertz.

8. The electronic device of claim 1, wherein the third frame is generated from image data associated with a third frame rate that is less than the threshold rendering frame rate.

9. The electronic device of claim 1, wherein the one or more processors are configured to:

determine whether each frame of a threshold number of consecutive frames of the content is associated with a frame rate that is greater than or equal to the threshold rendering frame rate; and in response to determining that each frame of the threshold number of consecutive frames of the content is associated with a frame rate that is greater than or equal to the threshold rendering frame rate, determine the overdrive gray level.

10. A method comprising:

determining that each frame of a number of frames of a plurality of frames is at or above a threshold frame rendering rate; and in response to determining that each frame of the number of frames of the plurality of frames is at or above the threshold frame rendering rate, determining a first gray level for a first frame of the plurality of frames of content based on a second gray level associated with a second frame of content, wherein the second frame of content is included in the number of the plurality of frames of content.

11. The method of claim 10, wherein:

each frame of the plurality of frames comprises a respective frame rendering rate; and each frame rendering rate is associated with a scrolling speed of a display.

12. The method of claim 10, wherein the threshold frame rendering rate is sixty hertz.

13. The method of claim 10, wherein determining the first gray level comprises altering a third gray level associated with the first frame based on the third gray level and the second gray level.

14. The method of claim 10, comprising a third frame of the plurality of frames associated with a second frame rendering rate, wherein the method comprises:

determining whether the second frame rendering rate is equal to or greater than the threshold frame rendering rate; and inserting a fourth frame into the third frame when the second frame rendering rate is less than the threshold frame rendering rate.

15. The method of claim 10, wherein the number of frames of the plurality of frames comprises three consecutive frames.

16. The method of claim 15, wherein the first frame is not included in the number of frames of the plurality of frames.

17. An image processing system, comprising:

a remap look-up table configured to:

receive first frame data comprising a first gray level;

receive second frame data comprising a second gray level; and determine an overdrive over-compensation mitigation gray level based on the first gray level and the second gray level;

an overdrive look-up table configured to:

receive third frame data comprising a third gray level;

receive the overdrive over-compensation mitigation gray level; and determine an overdrive gray level based on the third gray level and the overdrive over-compensation mitigation gray level; and one or more processors configured to perform a brightness band adjustment such that a first luminance of a display associated with the first frame data is increased to a second luminance of the display associated with the third frame data.

18. The image processing system of claim 17, comprising a driver integrated circuit configured to cause the display to display a frame of content based on the third frame data and the overdrive gray level.

19. The image processing system of claim 17, wherein the overdrive over-compensation mitigation gray level is different than the first gray level and the second gray level.

20. The image processing system of claim 17, wherein the one or more processors are configured to generate the first frame data, second frame data, and third frame data.

* * * * *